US006790169B2

(12) United States Patent
Koch et al.

(10) Patent No.: US 6,790,169 B2
(45) Date of Patent: Sep. 14, 2004

(54) CENTRIFUGE WITH FEED TUBE ADAPTER

(75) Inventors: Richard James Koch, Magnolia, TX (US); Kenneth Wayne Seyffert, Houston, TX (US); John Patrick Wright, Kerrville, TX (US); Subrata Mitra, The Woodlands, TX (US)

(73) Assignee: Varco I/P, Inc., Houston, TX (US)

( * ) Notice: Subject to any disclaimer, the term of this patent is extended or adjusted under 35 U.S.C. 154(b) by 114 days.

(21) Appl. No.: 10/272,535

(22) Filed: Oct. 16, 2002

(65) Prior Publication Data

US 2003/0096691 A1 May 22, 2003

Related U.S. Application Data

(63) Continuation-in-part of application No. 10/109,617, filed on Mar. 28, 2002, which is a continuation-in-part of application No. 09/652,418, filed on Aug. 31, 2000, now Pat. No. 6,605,029.

(51) Int. Cl.[7] ..... B04B 1/20

(52) U.S. Cl. ..... 494/53; 494/54

(58) Field of Search ..... 494/52–54, 56, 494/84; 210/377, 380.1, 380.3

(56) References Cited

U.S. PATENT DOCUMENTS

| | | | | |
|---|---|---|---|---|
| 832,191 A | * | 10/1906 | Holzer | 494/54 |
| 924,376 A | * | 6/1909 | Phillips | 494/53 |
| 1,027,134 A | * | 5/1912 | Leitch | 366/222 |
| 1,572,299 A | * | 2/1926 | McEntire | 494/51 |
| 1,659,683 A | * | 2/1928 | Dougan | |
| 1,806,241 A | * | 5/1931 | Dupuis | 494/51 |
| 1,885,154 A | | 11/1932 | Strezynski et al. | |
| 2,129,992 A | * | 9/1938 | De Mattia | 494/53 |
| 2,578,456 A | | 12/1951 | Smith | |
| 2,612,314 A | | 9/1952 | Huelsdonk | |
| 2,703,676 A | | 3/1955 | Gooch | |
| 2,711,854 A | | 6/1955 | Kjellgren | |

(List continued on next page.)

FOREIGN PATENT DOCUMENTS

| | | | |
|---|---|---|---|
| DE | 193997 | | 7/1904 |
| EP | 0602766 | | 6/1994 |
| GB | 1053222 | * | 8/1963 |
| WO | WO 93/13865 | | 12/1992 |

OTHER PUBLICATIONS

SC—35 HS High Speed Decanting Centrifuge, Sweco Oilfield Services, 1995.

Roots XLP Whispair Extra Low Pulse Iri–Lobe Blowers, Roots Dresser, 1998.

Industrial Model 1850 ss FVSI, Brandt/South–West, 1998.

SC–35 HS High Speed Decanting Centrifuge, Brandt/EPI, 2 pp., 1996.

(List continued on next page.)

*Primary Examiner*—Charles E. Cooley
(74) *Attorney, Agent, or Firm*—Guy McClung

(57) ABSTRACT

Centrifuges and conveyor apparatuses for centrifuges, the conveyor apparatus, in one aspect, having a plurality of spaced-apart flight members spaced apart along the length of the conveyor apparatus, a plurality of support members extending between, and connected to the spaced-apart flight members, the support members spaced-apart around the plurality of spaced-apart flight members, a nose member with a target end within the plurality of support members, and a feed tube for feeding fluid having a fluid exit end within the conveyor, fluid exiting the fluid exit end flowable to the target end of the nose member; a centrifuge with such a conveyor apparatus; in one aspect the conveyor apparatus also having at least one wear protector on at least one flight member of the spaced-apart flight members and/or the conveyor apparatus having fluid accelerating apparatus and at least one wear protector positioned adjacent the accelerating apparatus to protect a flight or a support member.

28 Claims, 23 Drawing Sheets

U.S. PATENT DOCUMENTS 2,961,154 A 11/1960 Bergey
3,070,291 A 12/1962 Bergey
3,170,874 A 2/1965 Iono
3,228,592 A 1/1966 Shapiro
3,268,159 A 8/1966 Kern
3,428,246 A 2/1969 Finkelston
3,568,920 A 3/1971 Nielsen
3,620,442 A 11/1971 Halloran
3,764,062 A * 10/1973 Brautigam ..... 494/54
3,788,392 A * 1/1974 Abbott et al. ..... 165/92
3,795,361 A 3/1974 Lee
3,831,764 A 8/1974 Halloran
3,885,734 A 5/1975 Lee
3,934,792 A 1/1976 High et al.
3,937,317 A * 2/1976 Fleury, Jr. ..... 198/676
3,967,778 A * 7/1976 Hunwick ..... 494/29
3,977,515 A * 8/1976 Lewoczko ..... 198/677
4,000,074 A 12/1976 Evans
4,003,115 A * 1/1977 Fisher ..... 29/889
4,006,855 A * 2/1977 Merzenich ..... 494/54
4,070,290 A 1/1978 Crosby
4,085,888 A 4/1978 Jager
4,142,669 A 3/1979 Burlet
4,209,128 A 6/1980 Lyons
4,228,949 A 10/1980 Jackson
4,240,578 A 12/1980 Jackson
4,262,841 A 4/1981 Berber et al.
4,298,160 A 11/1981 Jackson
4,298,162 A 11/1981 Hohne
4,299,353 A 11/1981 Bruning et al.
4,327,862 A 5/1982 Jakobs
4,328,925 A * 5/1982 Shapiro ..... 494/54
4,334,647 A 6/1982 Taylor
4,339,072 A 7/1982 Hiller
4,378,906 A 4/1983 Epper et al.
4,411,646 A 10/1983 Cyphelly
4,449,967 A * 5/1984 Caldwell ..... 494/54
4,451,247 A 5/1984 Ostkamp et al.
4,743,226 A 5/1988 Day et al.
4,961,722 A 10/1990 Taylor et al.
5,147,277 A 9/1992 Shapiro
5,151,079 A 9/1992 Flanigan et al.
5,160,441 A 11/1992 Lundquist
5,182,020 A 1/1993 Grimwood
5,203,762 A 4/1993 Cooperstein
5,354,255 A * 10/1994 Shapiro ..... 494/53
5,364,335 A 11/1994 Franzen et al.
5,374,234 A * 12/1994 Madsen ..... 494/53
5,378,364 A 1/1995 Welling
5,380,266 A 1/1995 Leung et al.
5,401,423 A 3/1995 Leung et al.
5,403,260 A 4/1995 Hensley
5,403,486 A 4/1995 Leung
5,423,734 A 6/1995 Leung
5,429,581 A * 7/1995 Michaud et al. ..... 494/54
5,520,605 A 5/1996 Leung et al.
5,527,258 A 6/1996 Leung et al.
5,527,474 A 6/1996 Leung
5,545,119 A * 8/1996 Schilp et al. ..... 494/56
5,551,943 A 9/1996 Leung et al.
5,586,966 A * 12/1996 Wood ..... 494/37
5,632,714 A 5/1997 Leung et al.
5,643,169 A 7/1997 Leung et al.
5,651,756 A 7/1997 Leung
5,653,674 A 8/1997 Leung
5,658,232 A 8/1997 Leung
D386,874 S 11/1997 Glaun
5,683,343 A 11/1997 Leung
D387,534 S 12/1997 Glaun
D388,583 S 12/1997 Glaun
5,695,442 A 12/1997 Leung et al.
D388,924 S 1/1998 Glaun
5,769,776 A 6/1998 Leung et al.
5,771,601 A 6/1998 Veal et al.
5,772,573 A 6/1998 Hao
5,814,230 A 9/1998 Willis et al.
5,840,006 A 11/1998 Leung et al.
5,865,539 A * 2/1999 Rogers ..... 366/325.8
5,913,767 A 6/1999 Feldkamp et al.
5,942,130 A 8/1999 Leung
5,948,256 A 9/1999 Leung
5,948,271 A 9/1999 Wardwell et al.
5,958,235 A 9/1999 Leung
5,971,907 A * 10/1999 Johannemann et al. ..... 494/37
6,063,292 A 5/2000 Leung
6,077,210 A 6/2000 Leung et al.
6,109,452 A 8/2000 Leung et al.
6,110,096 A 8/2000 Leung et al.
6,123,656 A 9/2000 Michelsen
6,143,183 A 11/2000 Wardwell et al.
6,145,669 A 11/2000 Leung
6,193,070 B1 2/2001 Rowney et al.
6,193,076 B1 2/2001 Hensley
6,206,818 B1 * 3/2001 Deschamps ..... 494/54
6,230,899 B1 5/2001 Hensley
6,241,901 B1 6/2001 Leung
6,267,250 B1 7/2001 Leung et al.
D448,488 S 9/2001 Chaffiotte et al.
6,432,299 B1 8/2002 Hensley et al.
6,605,029 B1 * 8/2003 Koch et al. ..... 494/53

OTHER PUBLICATIONS

SC–4 Decanting Centrifuge, 2 pp. Brandt, 1997.
"Low Pressure Mud Systems For Deepwater Operations," Montgomery, Hart's Petroleum Engineer Int'l, Dec. 1997.
Swaco Geolograph, 1993 Catalog, pp. 9, 12, 20; 1993.
Int'l Search Report, PCT/GB01/03891.
"Committed To Excellence In Manufacturing & Rebuilding For the Centrifuge Industry," Brandt/Southwest, 1991.
Solids Control Equipment, Contrifuges, Kem–Tron Technologies, Inc., 2002.
A Complete Line of Solids Control Equipment, Derrick Equipment Co., p. 12, 2002 (centrifuge introduced 2001).

* cited by examiner

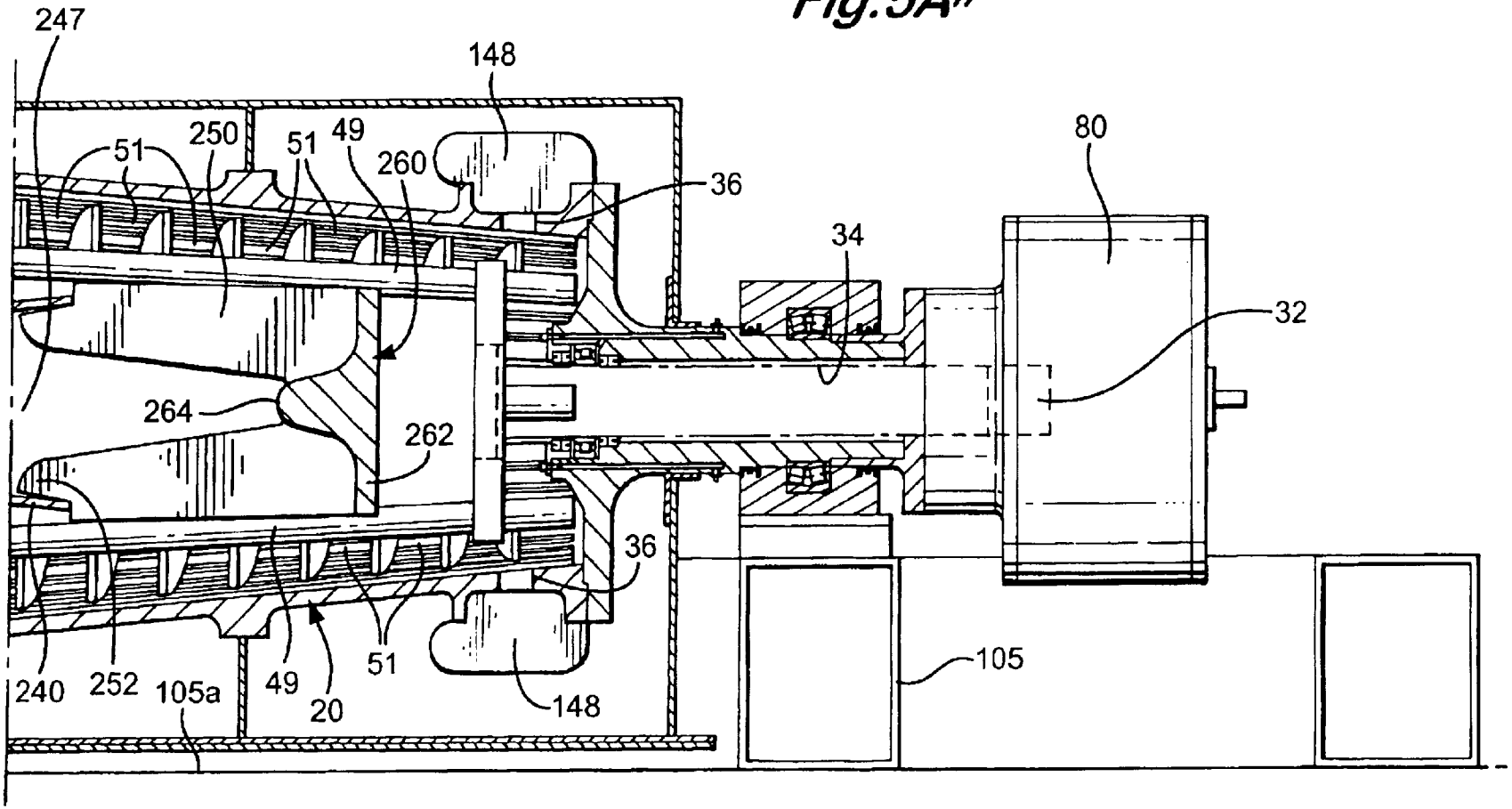
Fig. 5A//

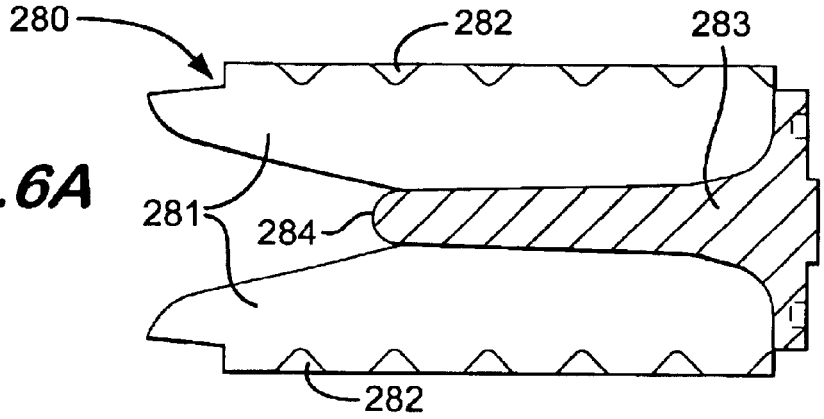
Fig.6A
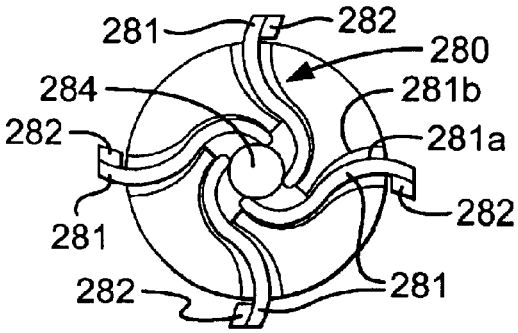
Fig.6B
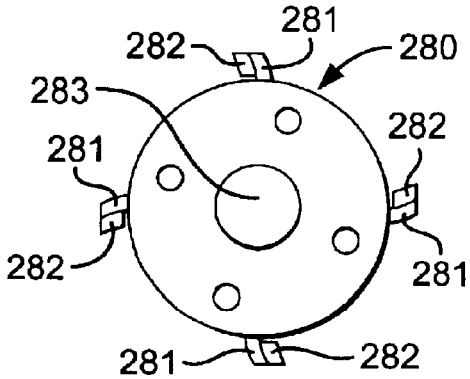
Fig.6C
Fig.6D
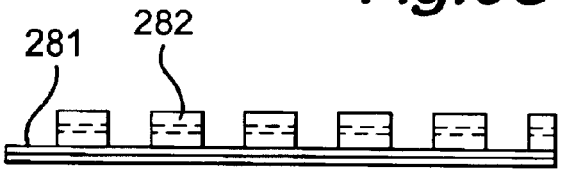
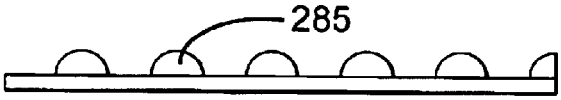
Fig.6E
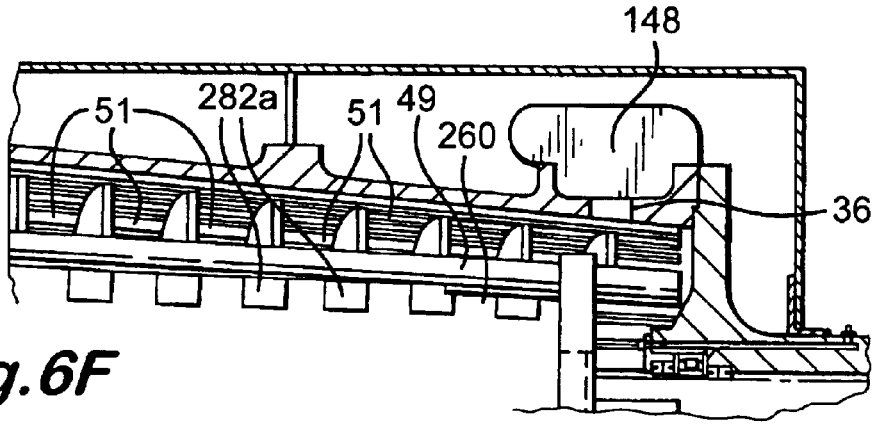
Fig.6F

CENTRIFUGE WITH FEED TUBE ADAPTER

RELATED APPLICATION

This is a continuation-in-part of U.S. Ser. No. 10/109,617 filed Mar. 28, 2002 which is a continuation-in-part of U.S. Ser. No. 09/652,418 filed Aug. 31, 2000, U.S. Pat. No. 6,605,029 filed Aug. 12, 2003 both incorporated herein fully for all purposes.

BACKGROUND OF THE INVENTION

Field of the Invention

This invention relates generally to centrifuges, and in certain particular aspects to decanting centrifuges with a rotating bowl, with or without a conveyor or scroll.

Description of Related Art

The prior art discloses a variety of decanter centrifuges or "decanters" which, in many embodiments, include a rotating centrifuge bowl rotating at one speed and in which a screw conveyor ("scroll") revolves at a slightly different speed. Other centrifuges have no such screw conveyor or scroll. Centrifuges are capable of continuously receiving feed in the bowl and of separating the feed into layers of light and heavy phase materials (e.g. liquids and solids) which are discharged separately from the bowl. In those apparatuses with a screw conveyor structure that rotates at a differential speed with respect to the bowl, the conveyor moves or "scrolls" an outer layer of heavy phase or solids slurry material to a discharge port or ports usually located in a tapered or conical end portion of the bowl. Centrifugal force tends to make the light phase material discharge through one or more ports usually located at an opposite end of the bowl. Typically the bowl is solid. Some bowls have port(s) to reject the heavier solids phases.

Centrifugal separation results, preferably, in a discharge containing light phase material with little or no heavy phase material, and heavy phase material containing only a small amount of light phase material. When the light phase material is water and the heavy phase material contains soft solids, it is preferred that fairly dry solids and clean water be separately discharged.

Many different industries use decanter centrifuges in varied applications. They are used in the oil industry to process drilling mud to separate undesired drilling solids from the liquid mud. Some decanter centrifuges, because of their continuous operation, have the advantage of being less susceptible to plugging by solids. Also, they may be shut down for long or short periods of time and then restarted with minimum difficulty, unlike certain centrifuges which require cleaning to remove dried solids. Often the solids/liquid mixture is processed at extraordinarily high feed rates. To accommodate such feed rates, high torques are encountered, much energy is required to process the mixture, and the physical size of the centrifuge can become enormous.

As larger feed volumes are processed in a given centrifuge machine, the clarification capability of the centrifuge decreases due to decreased retention or residence time, partial-acceleration or nonacceleration (slippage) of the feed fluid (the solids/liquid mixture), radial deceleration of the fluid moving through the conveyor, and turbulence created by the movement and/or focusing of large volumes of fluid through ports that tend to transmit and/or focus a high volume flow in an area exterior to the conveyor that induces undesirable turbulence in that area and results in excess wear and abrasion to parts that are impacted by this flow. The turbulent fluid exiting from the ports impedes or prevents solids from flowing to solids exit ports and ports near the centrifuge's drainage deck or "beach" impedes solids flow up the beach.

FIG. 1 shows one typical prior art decanting centrifuge that removes free liquid from separated solids. A rotating bowl creates very high G-forces and forms a liquid pool inside the bowl. The free liquid and finer solids flow towards the larger end of the centrifuge and are removed through effluent overflow weirs. Larger solids settle against the bowl wall, forming a cake. These solids are pushed by a screw conveyor up out of the pool and across a drainage deck (conical section), or "beach". Dewatering or drying takes place during the process of the solids moving up the beach, with the deliquified solids discharged through a series of underflow solids ports. A gear box connects the conveyor to the bowl, causing the conveyor to rotate in the same direction as the bowl, but at a slightly different speed. This speed differential is required to convey and discharge solids.

The interior end of the feed tube is relatively close to a wall or member defining an end of an acceleration chamber, thus fluid exiting from the feed tube into the acceleration chamber has relatively little space in which to slow down. This relatively high speed fluid is, therefore, turbulent and can wear away parts of the acceleration chamber. Also exiting from the acceleration chamber via exit ports this turbulent-relatively-high-speed fluid can inhibit the desired flow of separated solids both in the bowl toward the solids exit ports and toward the beach area and can wear away parts of the conveyor and bowl adjacent the acceleration chamber exit ports. Rather than dispersing and slowing down the fluid exiting from the acceleration chamber, the exit ports focus and/or speed up the fluid flow.

SUMMARY OF THE PRESENT INVENTION

The present invention discloses, in at least certain aspects, a conveyor for a centrifuge, the conveyor having a length and including a plurality of spaced-apart flight members spaced apart along the length of the conveyor or along a portion of the length of the conveyor, a plurality of support members extending between, and connected to the spaced-apart flight members, the support members spaced-apart (interiorly or exteriorly) around the plurality of spaced-apart flight members, the spaced-apart flight members and plurality of support members defining a plurality of open areas through which fluid to be treated by the centrifuge introduced into the conveyor is flowable from within the conveyor, and at least one accelerating impeller within and connected to the conveyor for accelerating some or substantially all of the fluid [or a plurality of such accelerator impellers (two, three, four, five, six, seven, eight, nine, ten, or more and in some aspects up to fifty such impellers)].

The present invention discloses, in at least certain aspects, a centrifuge that has a bowl with a hollow interior and a first bowl end spaced-apart from a second bowl end, apparatus for selectively rotating the bowl, and a conveyor rotatably mounted in the bowl, the conveyor having a length and including a plurality of spaced-apart flight members spaced apart along the length of the conveyor or along a portion of the length of the conveyor, a plurality of support members extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor, and at least one accelerating impeller within and connected to the conveyor for accelerating some or substantially all of the fluid [or a plurality of such accelerator impellers (two, three, four, five, six, seven, eight, nine, ten, or more and in some aspects up to fifty such impellers)].

The present invention discloses, in at least certain aspects, accelerator apparatus for accelerating fluid to be treated in a centrifuge [including a centrifuge with no conveyor or scroll and a centrifuge with a conveyor (including, but not limited to, a conveyor according to the present invention)] from an interior of a centrifuge [and from an interior of a conveyor when one is present] out therefrom into a centrifuge bowl, the accelerator apparatus having at least one accelerating impeller for accelerating fluid to be treated or a plurality of spaced-apart impellers, and the impeller(s) with a shape, viewed on end, that comprises a flowing curve extending out from a first central part [part of a center of a conveyor when one is present] and with a distal end aligned with an area on the bowl and/or conveyor not in alignment with the first central part, but radially spaced apart from the first central part; and, in certain particular aspects, between about 80 degrees and 110 degrees spaced apart; and in one particular aspect, about ninety degrees spaced-apart from said first central part.

The present invention discloses, in at least certain aspects, a central nose member for mounting within a bowl of a centrifuge and/or within a conveyor of a centrifuge, the central nose member removably or permanently connectible to the bowl and/or conveyor, the nose member with a nose end projecting from a plate, the nose end positionable to be contacted by fluid flowing from fluid entry apparatus into the centrifuge to direct and/or distribute fluid flow to enhance centrifugation, the plate secured to or formed of the nose member, the plate extendable across an inner space of the bowl and/or conveyor to prevent fluid flow past the plate; and, in certain aspects, the nose end having a curved surface that flows from the end of the nose member to the plate to facilitate fluid flow in a direction out from the bowl and/or conveyor.

The present invention discloses, in at least certain aspects, a flow enhancer connected to a bowl, to a conveyor, or to an accelerating impeller or, when present, a plurality of impellers, the flow enhancer for facilitating fluid flow out from the conveyor, the flow enhancer including a first ring spaced apart from a second ring, and a plurality of spaced-apart pins secured to and between the first ring and the second ring, the plurality of pins and portions of the interior surfaces of the first and second rings defining fluid flow passages through which fluid is accelerated by the flow enhancer, the first ring and the second ring each having a central opening through which fluid is flowable, fluid flowable through the central openings to the impeller(s), if present. Optionally, one of the rings can be deleted and the pins mounted to or formed of a single ring. In one aspect, the flow enhancer is used with impeller(s) that have a front end and a rear end, and the flow enhancer is connected to the front end (the end that initially is contacted by fluid from a feed tube or feed apparatus).

The present invention, in certain aspects, discloses a new decanting centrifuge which has a rotatable bowl within which rotates a caged conveyor at a different speed than the speed of rotation of the bowl. In certain aspects a caged or skeleton conveyor according to the present invention includes a plurality of spaced-apart flights within which and to which are secured a plurality of spaced-apart support beams, rods, or members so that fluid can flow freely with reduced turbulence between the beams, rods or members, into and out from the interior of the conveyor. The flights form a screw portion of the conveyor for conveying solids separated from fluid to be treated by the centrifuge from one end of the bowl to the other (at which there are one or more solids outlets). In one aspect the flights are in the form of a helix.

The present invention, in certain aspects, provides a decanting centrifuge with a relatively short feed tube or inlet nozzle (providing a larger or longer area for reduction of fluid velocity, reduction of feed tube vibration, and turbulence reduction) and one or more impeller's on the conveyor's interior which are impacted by fluid entering the centrifuge through the feed tube or inlet nozzle. In certain aspects the impellers (and related parts such as a nose member, chamber, and base) are made of material from the group of steel, stainless steel, hardfaced or carbide covered metal, plastic, molded poly urethane, fiberglass, polytetrafluoroethylene, aluminum, aluminum alloy, zinc, or zinc alloy, stellite, nickel, chrome, boron and/or alloys of any of these. The impellers (and related parts) may be removable and/or replaceable. Any part of a conveyor or centrifuge disclosed herein, especially parts exposed to fluid flow, may be coated with a protective coating, hardfaced, and/or covered with tungsten carbide or similar material.

A "velocity decrease" chamber or area, in certain embodiments, is, optionally, located past the nozzle (feed tube) (e.g. to the right of the interior end of the feed tube in FIGS. 2 and 5A). This unobstructed area may include space within a chamber (e.g. within a solid-walled hollow member open at both ends) disposed between the feed tube exit and either conveyor fluid exit areas or a radial acceleration apparatus within the conveyor. Fluid from the nozzle (e.g. two to two-and-one-half inches in internal diameter) moves through a chamber that disperses flowing fluid; provides a space to allow the fluid's velocity to decrease (velocity in the general direction of the horizontal or longitudinal axis of the centrifuge); and directs fluid to impact the impellers. Different interchangeable nozzles may be used. The nozzle exit end may be non-centrally located within the conveyor i.e.—not on the conveyor's longitudinal axis. A solid walled hollow member defining the chamber may be any suitable shape—e.g. but not limited to, conical, cylindrical, and/or triangular, square, rectangular, or polygonal in cross-section and any number of any known impellers, blades, or vanes may be used.

In certain embodiments fluid flows through the chamber and impacts a plurality of impellers that are connected to and rotate with the conveyor. The fluid impacts the impellers and is then moved radially outward by the blades toward the conveyor's flights. The impellers are configured and positioned to radially accelerate the fluid so that as the fluid passes the impellers outer edges, the fluid's speed (radial speed) is near or at the speed of a pool of material within the bowl—thus facilitating entry of this fluid into the pool or mass of fluid already in the bowl. By reducing or eliminating the speed differential between fluid flowing from the acceleration chamber and fluid already present in the bowl, turbulence is reduced, entry of solids of the entering fluid into the pool in bowl is facilitated, and more efficient solids separation results.

The present invention, in certain aspects, provides a centrifuge with a variable pneumatic backdrive or airbrake to control the differential speed of the conveyor. In one particular aspect a Roots XLP Whispair blower available from the ROOTS DRESSER CO. is used to provide selectively variable braking for a gearbox pinion, thus varying the relative rotational speed of the conveyor in the bowl. In one aspect a typical known automatic boost system (e.g. to increase scroll-to-bowl speed or vice-versa) is used with the backdrive to inhibit or prevent plugging. Alternatively, for any embodiment herein the conveyor may be driven by a motor and a braking apparatus provided for the bowl to selectively adjust the conveyor/bowl rotative speed differential.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

- New, useful, unique, efficient, nonobvious fluid accelerators for centrifuges; flow enhancers for centrifuges; nose members for centrifuges; and centrifuges with one, some or all these things;
- New, useful, unique, efficient, nonobvious centrifuge conveyors with open fluid flow areas, in one aspect at a beach end, and centrifuges with such a conveyor;
- New, useful, unique, efficient, nonobvious: devices and methods for centrifuges and for decanting centrifuges;
- Such centrifuges with dispersed and/or non-focused flow of fluid from an interior entry area, through a conveyor, into a bowl;
- Such centrifuges with a caged or skeleton conveyor;
- Such centrifuges with reduced fluid turbulence, particularly at points or areas at which fluid exits a conveyor to enter a bowl;
- Such centrifuges with a relatively short feed tube and/or one or more impellers impacted by fluid entering the centrifuge through a feed tube and/or with a chamber for dispersing fluid flow and/or to reduce its longitudinal velocity for directing fluid flow to the impeller(s);
- Such centrifuges with a pneumatic backdrive to adjust and control conveyor speed or bowl speed;
- Such centrifuges which effect increased settling and separation of solids;
- Such centrifuges with one or more wear protectors or wear shields on areas of blades or flights and/or on structural members (e.g. rods or supports) of a conveyor for combatting effects of forceful erosive and/or abrasive fluid flow;
- Such centrifuges with fluid drainage apparatus at a fluid introduction end around intercommunicating parts of a feed tube; and
- Such centrifuges with a feed tube extending from a fluid introduction end of the centrifuge through the centrifuge, with a feed tube fluid exit end positioned so that fluid exits the feed tube and flows to a fluid accelerator apparatus and/or to a target end of a nose member, in one aspect the nose member within fluid accelerator apparatus.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 6A is a side view of an accelerator according to the present invention for centrifuges. FIG. 6B is a front end view and FIG. 6C is a rear end view of the accelerator of FIG. 6A. FIG. 6D is a top view of an impeller for an accelerator as in FIG. 6A. FIG. 6E is a top view of an impeller according to the present invention for an accelerator according to the present invention. FIG. 6F is a side cross-section view of part of a centrifuge according to the present invention.

7A.

DESCRIPTION OF EMBODIMENTS PREFERRED AT THE TIME OF FILING FOR THIS PATENT

Figure 1:
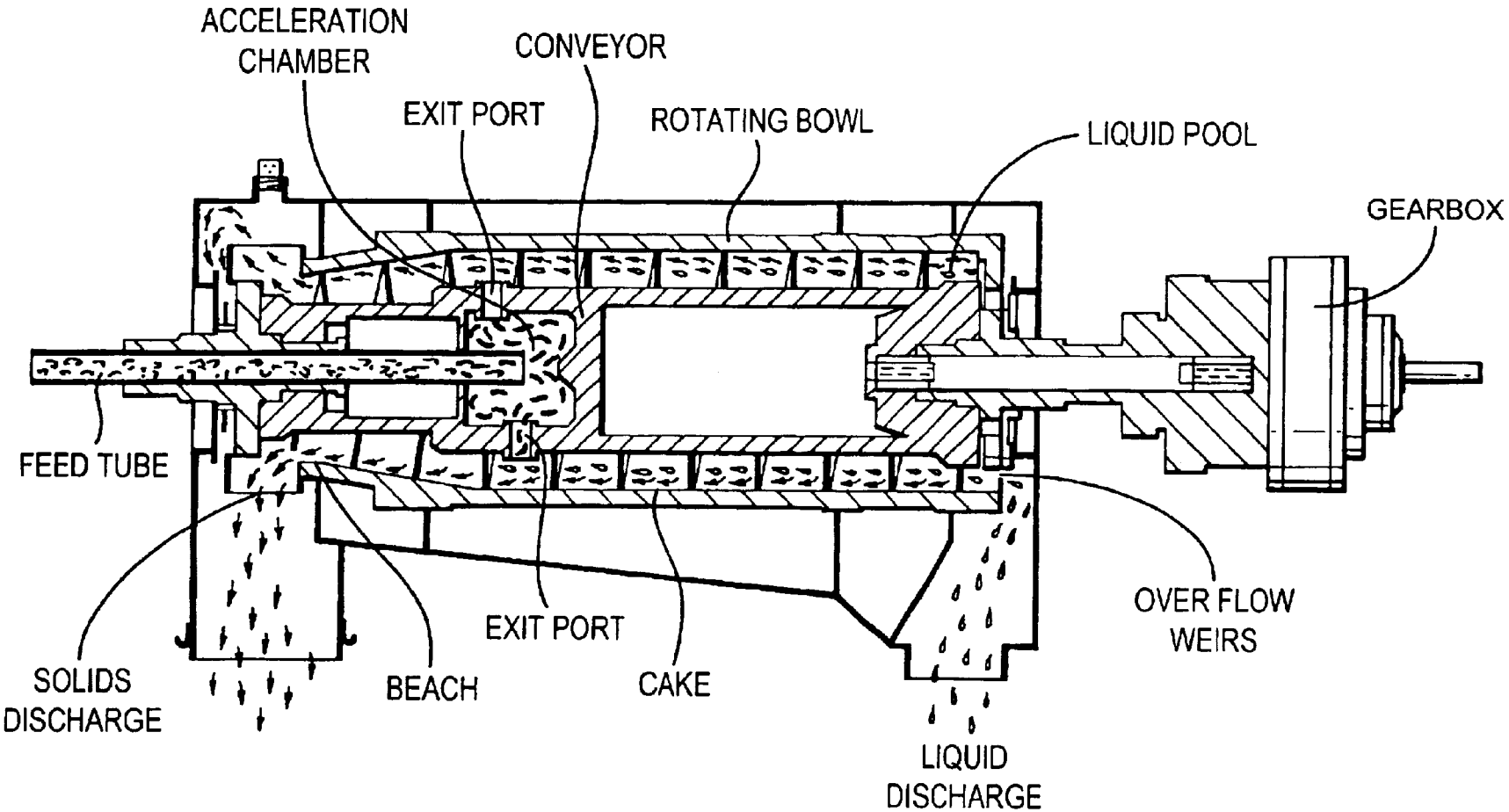
Fig. 1 PRIOR ART
FIG. 1 is a side cross-section view of a prior art decanting centrifuge.
Figure 2A:
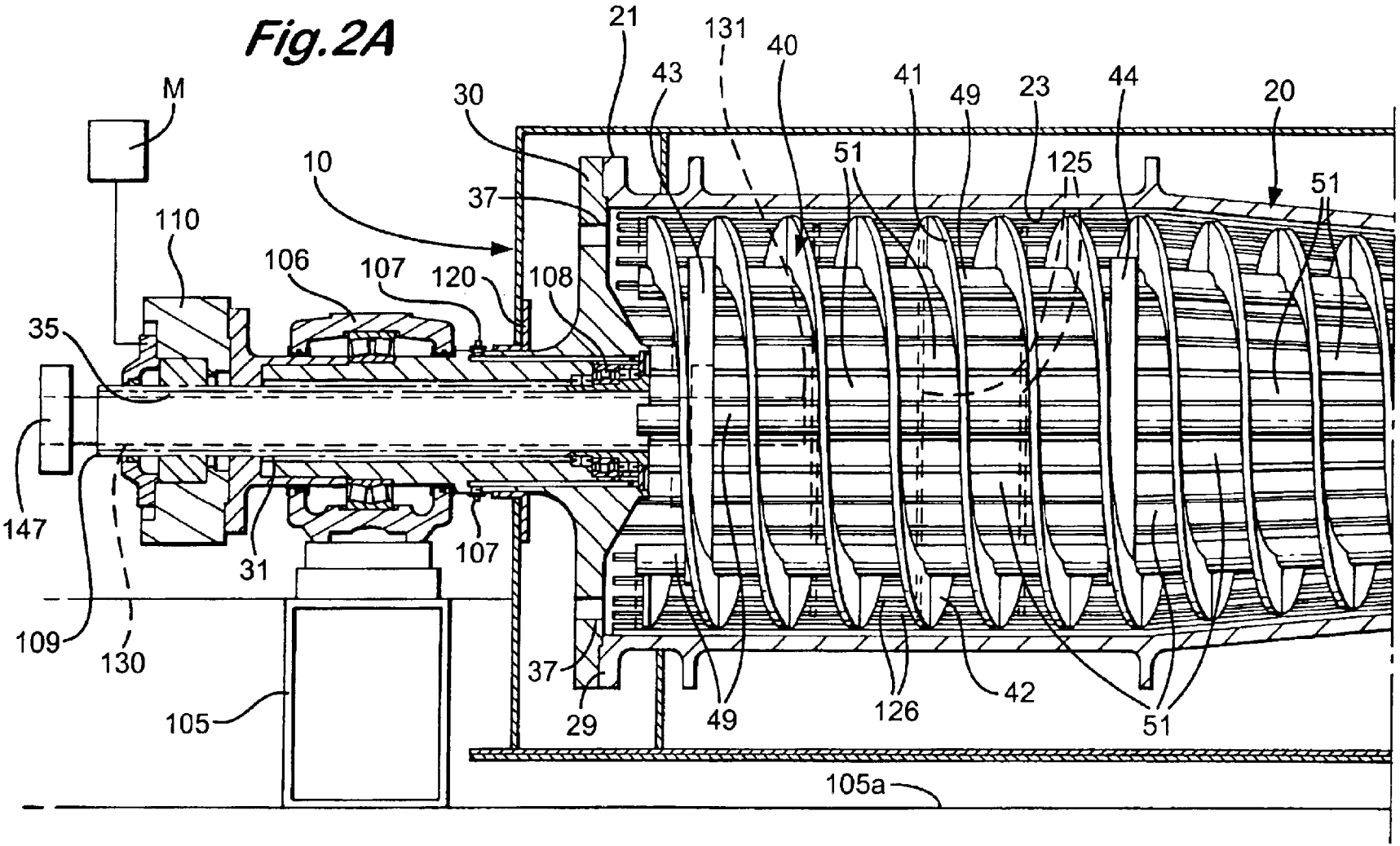
FIGS. 2A and 2B are side cross-section views of a decanting centrifuge according to the present invention, together referred to herein as "FIG. 2".
Figure 2B:
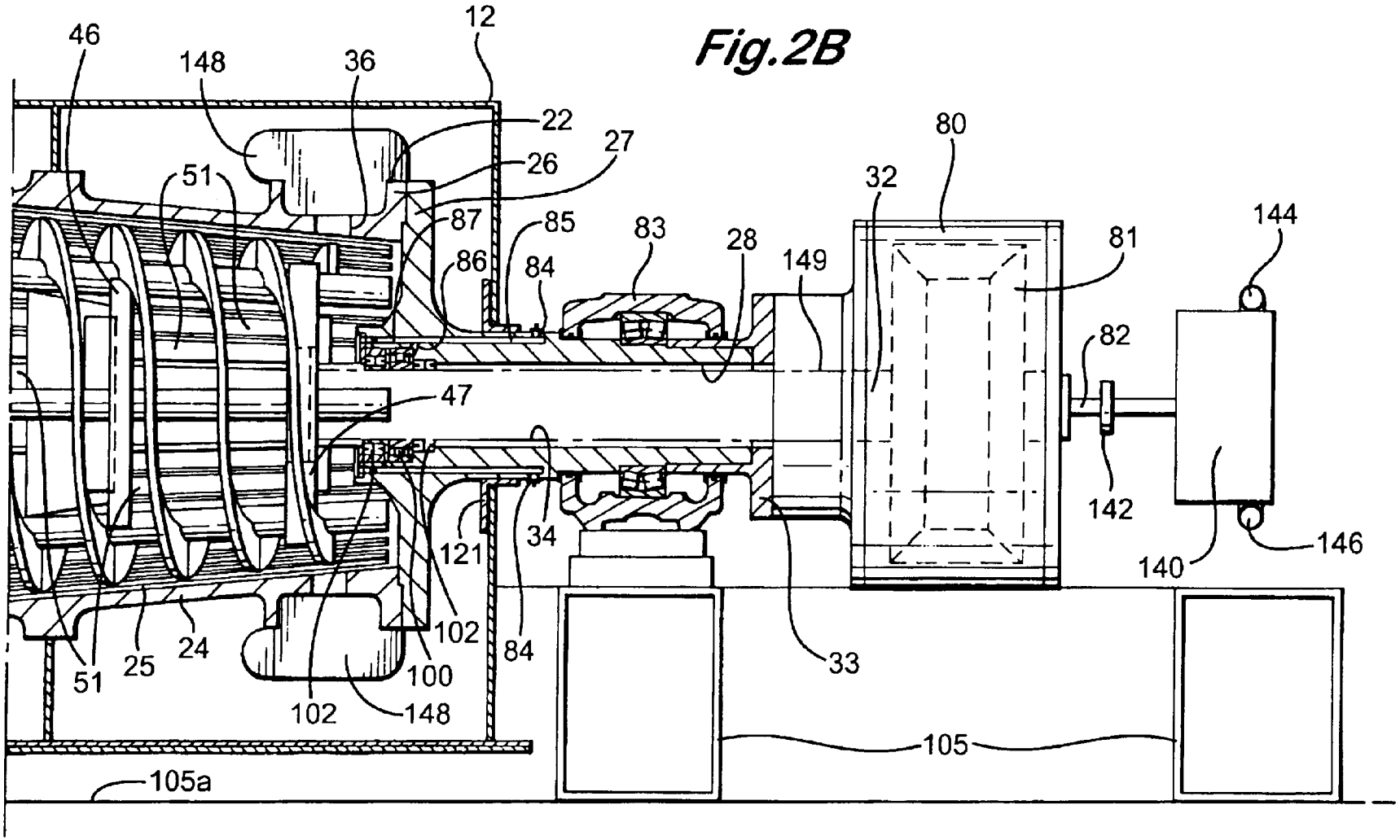
Figure 3A:
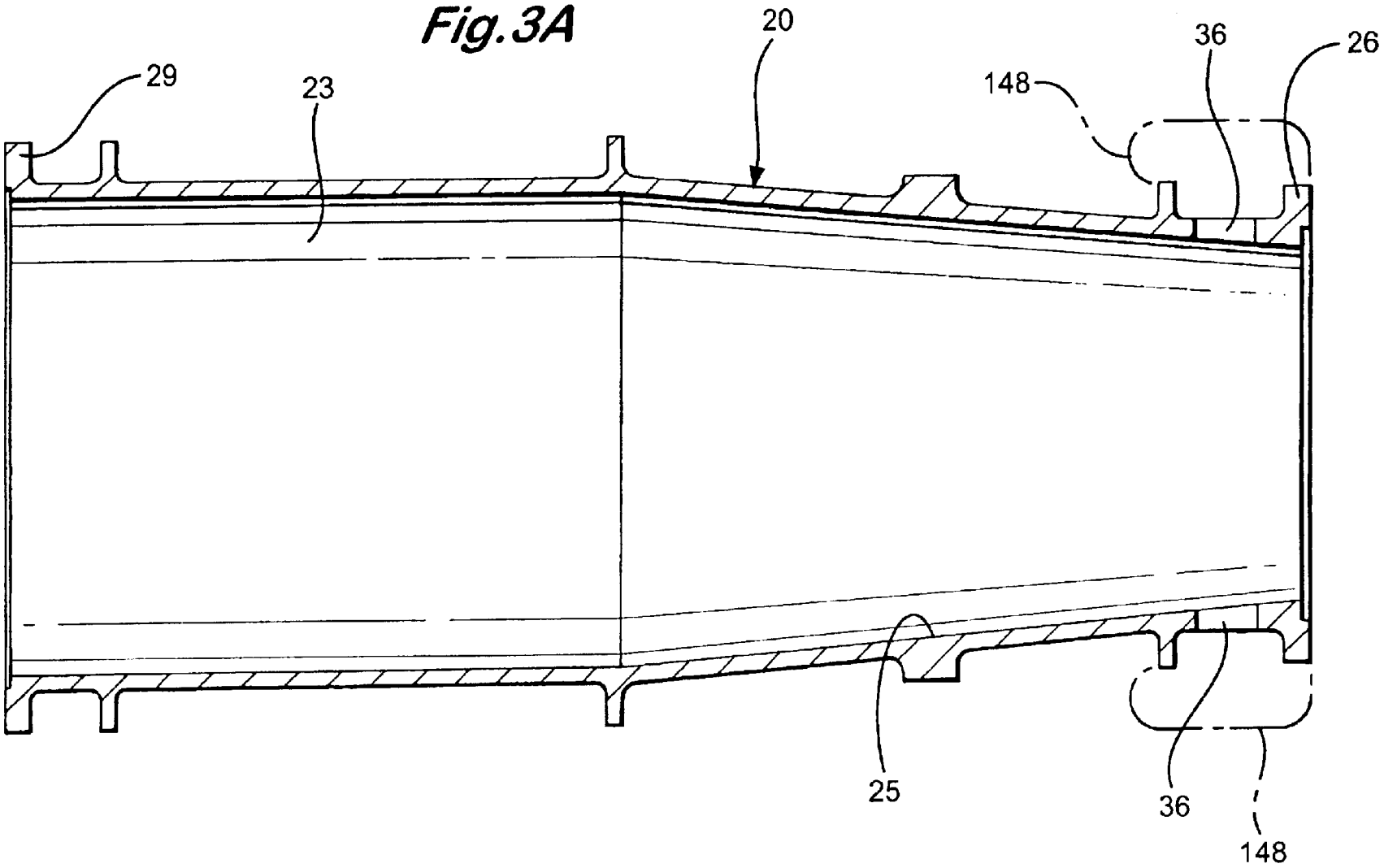
FIG. 3A is a side cross-section view of the bowl of the decanting centrifuge of FIG. 2.
Figure 3B:
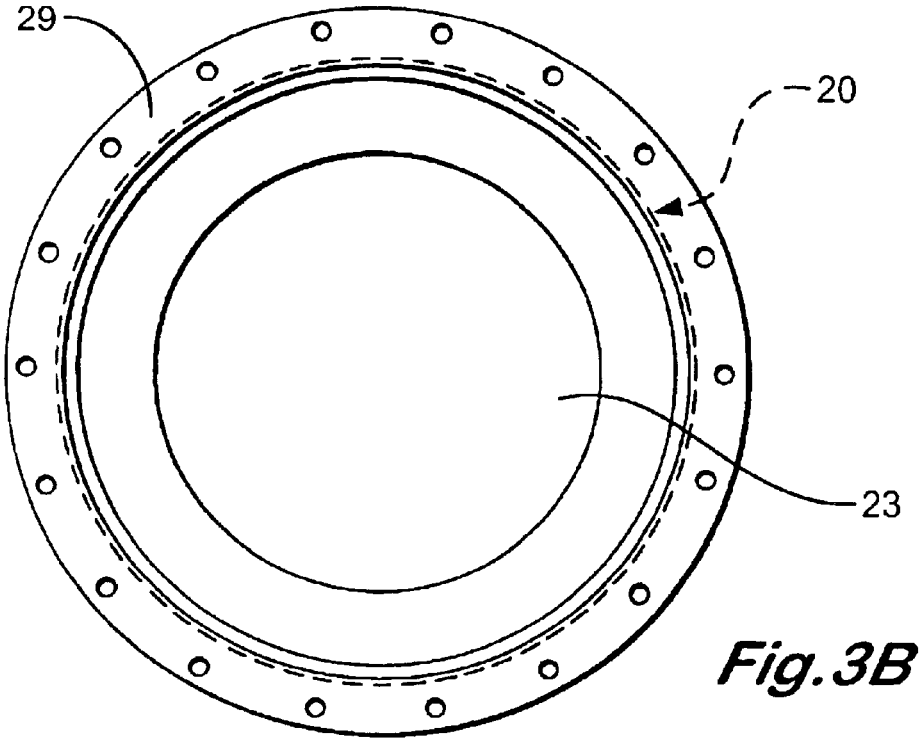
FIGS. 3B and 3C are end views of the bowl of FIG. 3A.
Figure 3C:
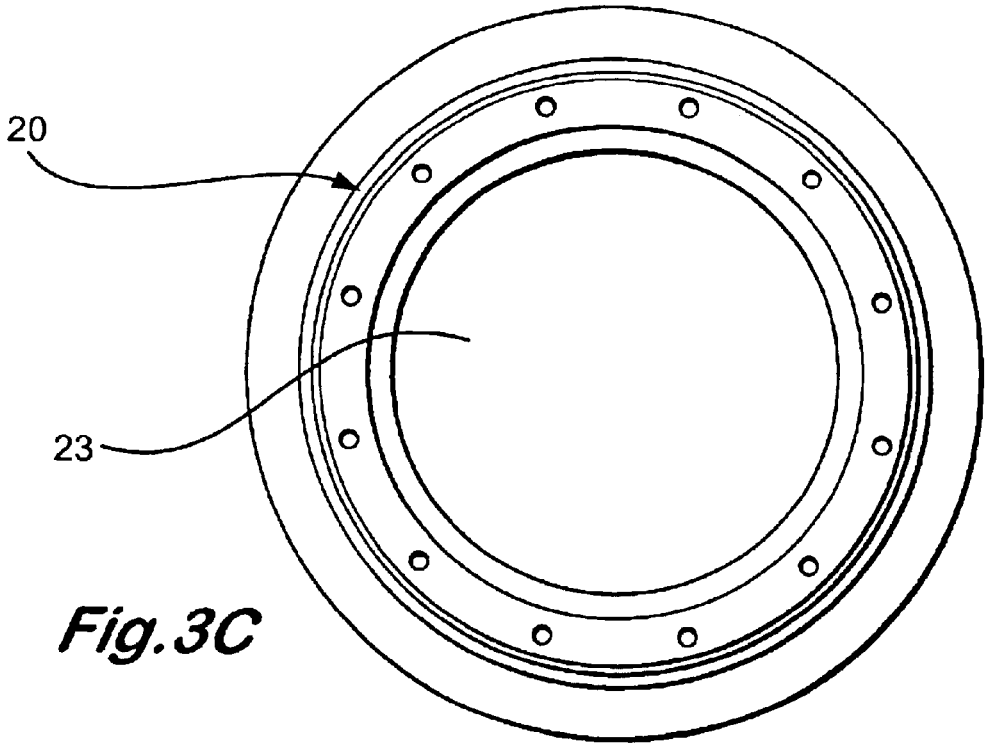

FIG. 2 shows a decanting centrifuge 10 according to the present invention which has an outer housing 12 within which is rotatably mounted a bowl 20 with a hollow interior 23. Within the hollow interior 23 of the bowl 20 is rotatably mounted a conveyor 40 that has a continuous helix or screw 41 that extends from a first end 21 of the bowl 20 to a second end 22 of the bowl 20. Supports 105 on a base 105*a* support the centrifuge (bowl, conveyor, outer housing, and other components). The supports 105 may themselves be supported on a skid.

A plurality of support rods 49 are disposed within the helix 41 and are connected at points of contact to flights or sections 42 of the helix 41, e.g. by bolting and/or welding. The flights 42 are sized so that they are separated a desired distance from the interior surface of the bowl 20 along the bowl's length. As is well known, the edges of the flights may be lined with side-by-side pieces or tiles made of sintered tungsten carbide or the edges themselves may be handfaced (as may any part of the apparatus). An end plate 43 is at one end of the helix 41, connected e.g. by welding, and an end plate 47 is at the other end.

Figure 4A:
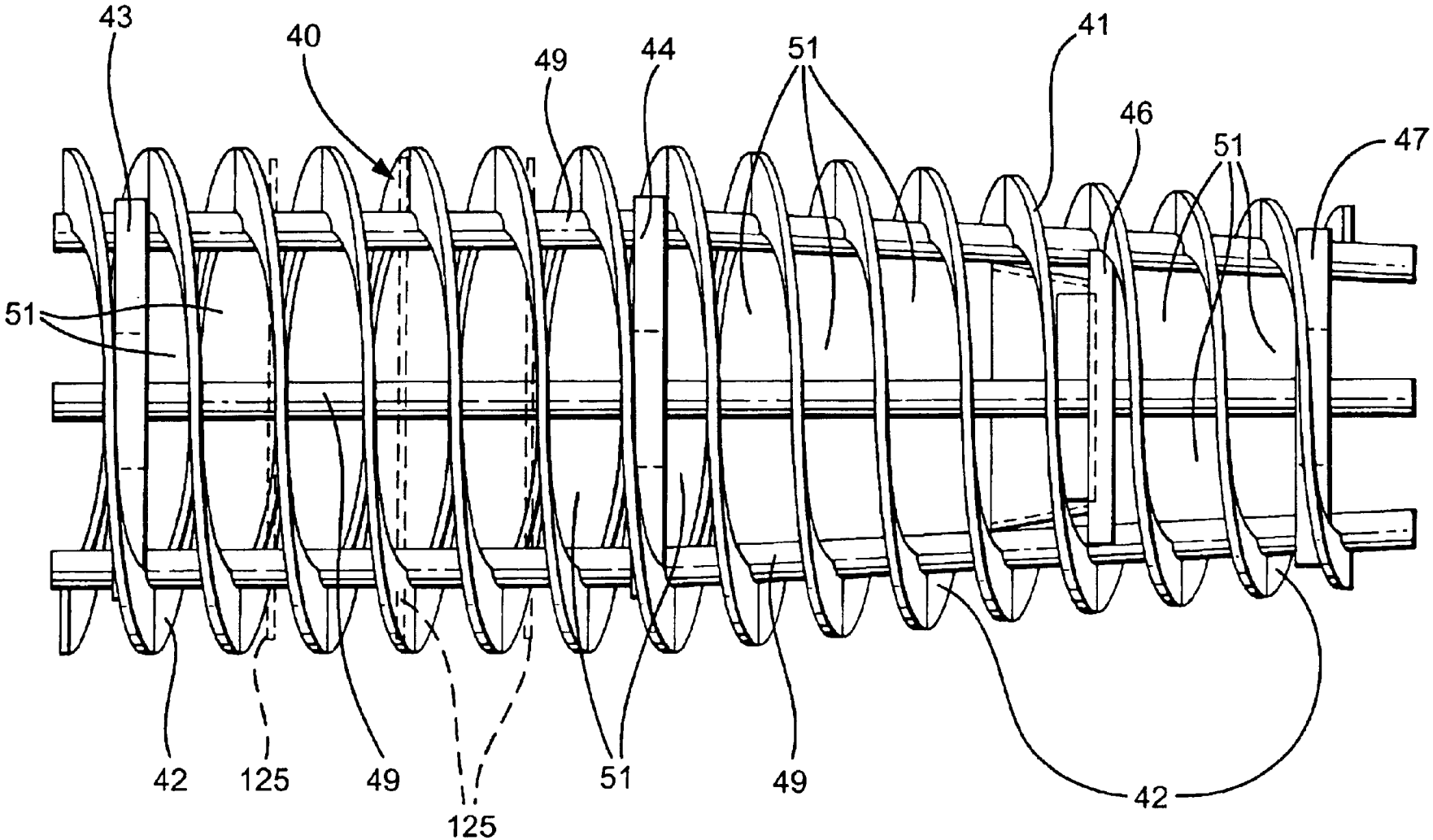
FIG. 4A is a side view of the conveyor of the centrifuge of FIG. 1
Figure 4B:
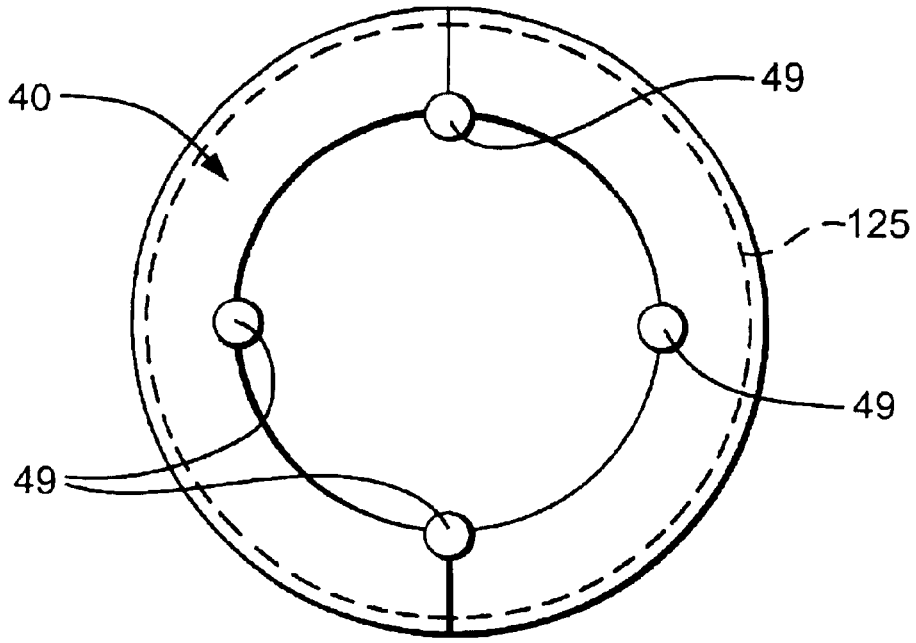
FIG. 4B is an end view of the conveyor of FIG. 4A.

Baffles 43, 44, and 46 are attached to the rods 49. Viewed on end these baffles are similar to the section of the conveyor 40 shown in FIG. 4B. The end baffles 43, 46 and plate 47 provide support and attachment points for the shafts (trunnions) that support the conveyor. Additional baffles may be used at any point in the conveyor for added strength and/or for apparatus detachment points.

Areas 51 between the rods 49 and the flights 42 (between each rod part and each flight part) are open to fluid flow therethrough. Alternatively portions of the conveyor may be closed off (i.e. areas between rod parts and flights are not open to fluid flow), e.g. but not limited to, closing off the left one quarter or one-third and/or the right one-quarter or one-third thereof; i.e., all or only a portion of the conveyor may be "caged". Due to the openness of the caged conveyor (and the fact that, in certain aspects, fluid is fed in a nonfocused manner and is not fed at a point or points adjacent the pool in the bowl or prior to the beach, and fluid is not fed from within the conveyor through a number of ports or orifices—as in the prior art fluid is fed out through several ports or areas that tend to focus fluid flow from the conveyor), solids in this fluid do not encounter the areas of relatively high turbulence associated with certain of the prior art feed methods and solids tend more to flow in a desired direction toward solids outlet(s) rather than in an undesired direction away from the beach and toward liquid outlets. Consequently, in certain embodiments according to the present invention the relative absence or diminished presence of turbulence in the pool in the bowl permits the centrifuge to be run at relatively lower speed to achieve desired separation; e.g. in certain aspects of centrifuges according to the present invention a bowl may be run at between 900 and 3500 rpm and a conveyor at between 1 and 100 rpm.

The bowl 20 has a conical or "beach" end 24 with a beach section 25. The beach section 25 may be (and, preferably, is) at an angle, in certain preferred embodiments, of between 3 and 15 degrees to the longitudinal axis of the bowl 20.

A flange 26 of the bowl 20 is secured to a bowl head 27 which has a channel 28 therethrough. A flange 29 of the bowl 20 is secured to a bowl head 30 which has a channel therethrough. A shaft 32 is drivingly interconnected with a gear system 81 of a transmission 80. A shaft 31 has a channel 35 therethrough through which fluid is introduced into the centrifuge 10. A motor M (shown schematically) interconnected (e.g. via one or more belts) with a driven sheave 110 selectively rotates the bowl 20 and its head 27 which is interconnected with the gear system 81 of the transmission 80 (and turning the bowl 20 thus results in turning of a trunnion or shaft 34).

A shaft 32 projecting from the transmission 80 is connected to the shaft 34. The transmission 80 includes a gear system 81 interconnected with pinion shaft 82 which can be selectively backdriven by a Roots blower 140 or other suitable pneumatic backdrive device (shown schematically in FIG. 2) connected thereto via a coupling 142 to change, via the gear system 18, the rotation speed of the shaft 32 and, therefore, of the conveyor 40. The blower 140 has an adjustable air inlet valve 144 and an adjustable air outlet valve 146 (the conveyor speed is adjustable by adjusting either or both valves). Alternatively a non-pneumatic backdrive may be used. The gear system 81 (shown schematically by the dotted line in the transmission 80) may be any known centrifuge gear system, e.g. but not limited to a known two-stage planetary star and cluster gear system.

Optionally, the shaft 82 is coupled to a throttle apparatus (not shown) which, in one aspect includes a pneumatic pump, e.g. an adjustable positive displacement pump [e.g. air, pneumatic, (according to the present invention) or non pneumatic] connected to the shaft 82 to provide an adjustable backdrive.

Solids exit through four solids outlet 36 (two shown) in the bowl 20 and liquid exits through liquid outlets 37 in the bowl 20. There may be one, two, three, four, five, six or more outlets 36 and 37. There are, in one aspect, four spaced-apart outlets 37 (two shown).

The shaft 34 extends through a pillow block bearing 83 and has a plurality of grease ports 84 in communication with grease channels 85, 86 and 87 for lubrication of the bearings and shafts. Bearings 100 adjacent the shaft 34 facilitate movement of the shaft Internal bearings can be lubricated, ringed, and sealed by seals 102 (that retain lubricant).

An end 109 of the shaft 31 extends through the driven sheave 110.

Mount rings 120, 121 secured at either end of the bowl 20 facilitate sealing of the bowl 20 within the housing 12. Two plows 148 (one, two, three four or more) on the bowl 20 scrape or wipe the area around solids outlets 36 so the outlets are not plugged and maintain or increase product radial speed as the bowl rotates to facilitate solids exit. The plows also reduce bowl drag on the housing by reducing solids accumulation around solids exit points.

A feed tube 130 with a flange 147 extends through the interior of the input shaft 31. The feed tube 130 has an outlet end 131. Fluid to be treated flows into an inlet end (left side in FIG. 2) of the feed tube.

Figure 5C:
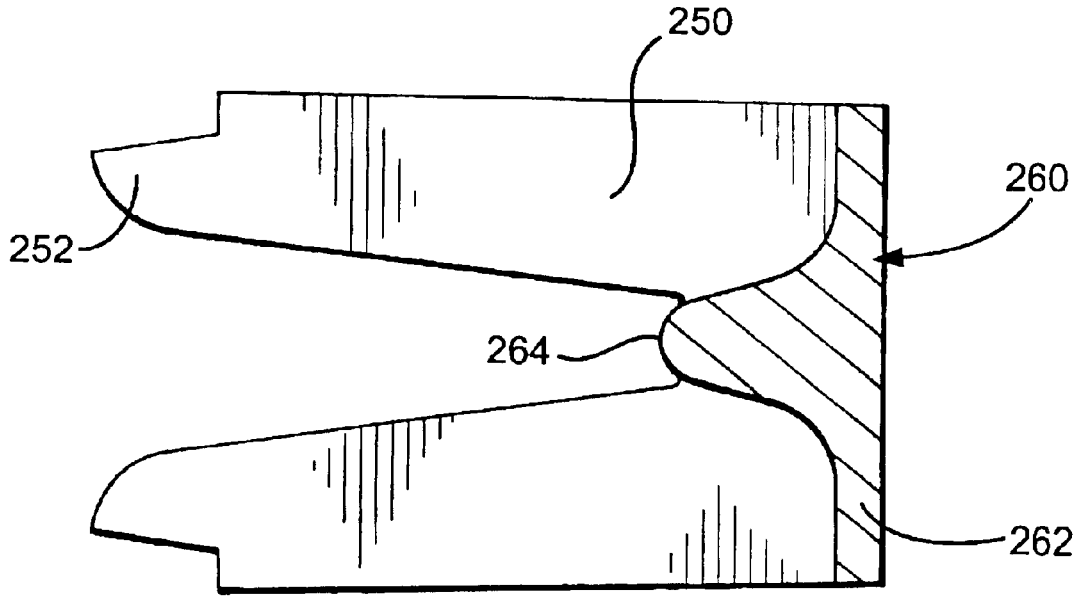
FIG. 5C is an enlargement of part of the centrifuge of FIG. 5A.

Optionally, one or a plurality of spaced-apart pool surface diffusers 125 are secured to the conveyor and diffuse or interrupt the unwanted flow of floating solids away from the beach area 24. The diffusers 125 are shown in FIGS. 2 and 5B. Solids may tend to move in upper layers (slurry-like material with solids therein) of material flowing away from the beach area and toward the liquid outlets 37. Diffusers 125 extend into these upper layers so that the solids in the upper slurry layer are pushed down by the diffusers and/or hit the diffusers and fall down and out from the upper flowing slurry layer into lower areas or layers not flowing as fast and/or which are relatively stable as compared to the layers so that the solids can then continue on within the bowl toward the inner bowl wall and then toward the beach.

Optionally, a plurality of spaced-apart traction strips or rods 126 facilitate movement of the solids to the beach and facilitate agglomeration of solids and solids build up to facilitate solids conveyance.

Figure 5A:
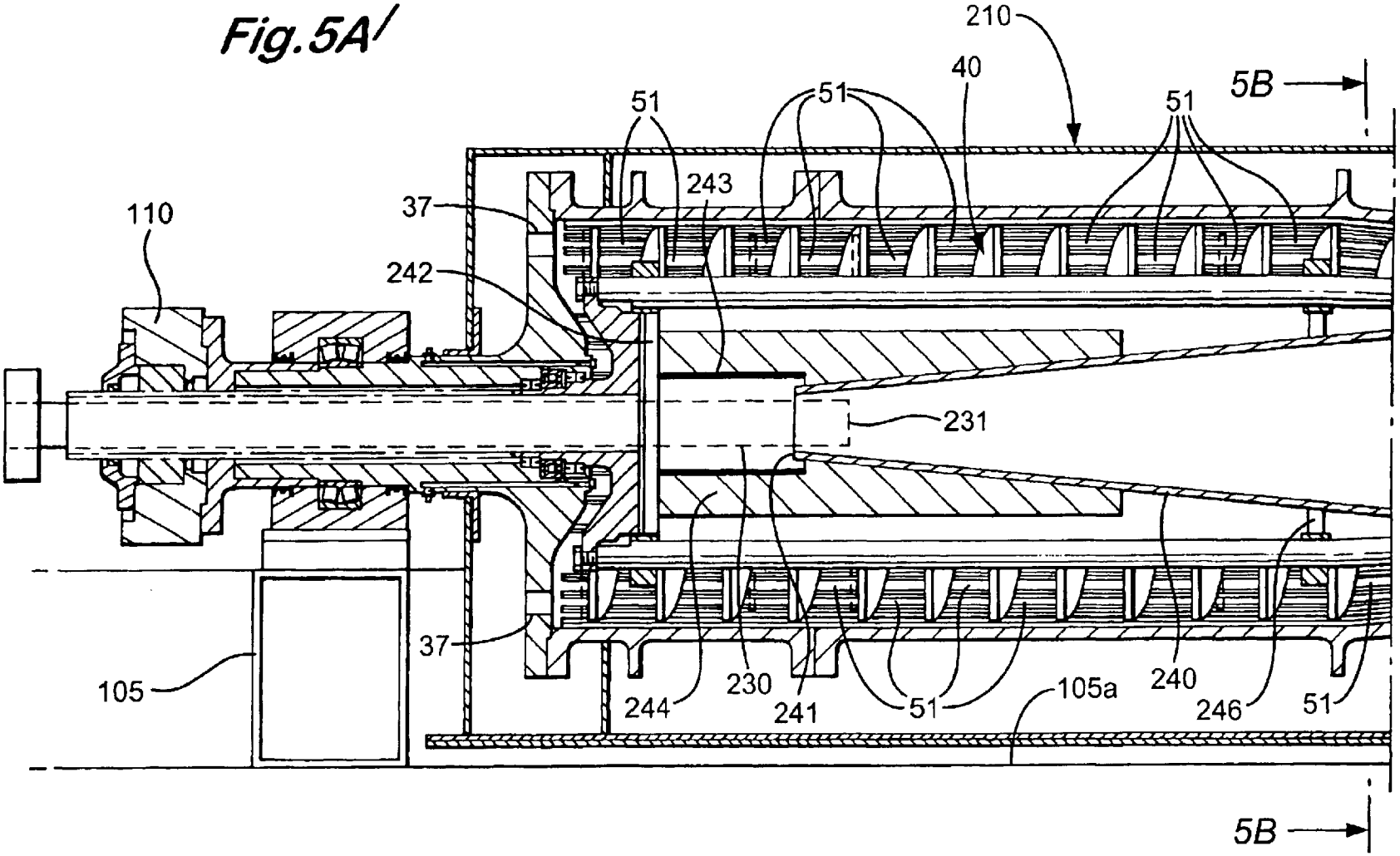
FIGS. 5A' and 5A" are side cross-section views of a decanting centrifuge according to the present invention, together referred to herein as "FIG. 5".
Figure 5B:
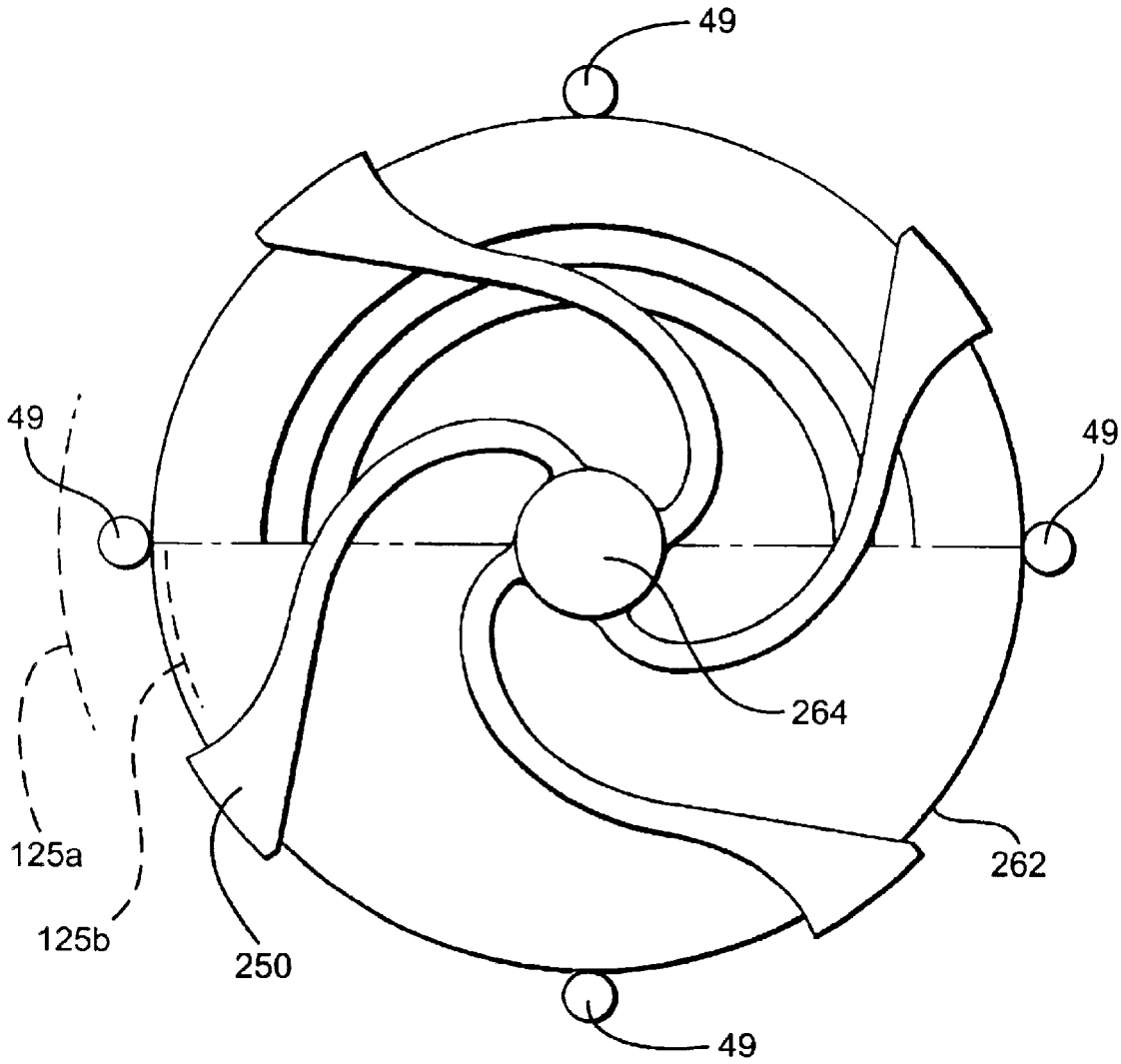
FIG. 5B is a cross-section view along line 5B—5B of FIG. 5A.

FIG. 5A illustrates a decanting centrifuge 210 like the centrifuge 10 of FIG. 2 (and like numerals indicate the same parts). The centrifuge 210 has a feed tube 230 with an exit opening 231 from which material to be processed exits and enters into a conical portion of a chamber 240 through an entrance opening Although the chamber 240 is generally conical, it may be any desired cross-sectional shape, including, but not limited to cylindrical (uniformly round in cross-section from one end to the other) or polygonal (e.g. square, triangular, rectangular in cross-section). Items 230, 240, 242 and 244 may be welded together as a unit.

The end of the feed tube 230 within the conveyor 40 extends through a mounting plate 242 and a hollow pipe 243. The pipe 243 and a portion of the chamber 240 are supported in a support member 244. A support ring 246, connected to rods 49 (two shown; four spaced-apart around the conveyor as in FIG. 2), supports the other end of the chamber 240. Impellers 250 secured to (welded, or bolted) (or the impellers and nose member are an integral piece, e.g. cast as a single piece) nose member 260 have forward end portions 252 that abut an end of the chamber 240 and project into a fluid passage end 247 of the chamber 240 from which fluid exits from the chamber 240. In one particular aspect the distance from the exit end 231 of the feed tube 230 to the fluid passage end 247 of the chamber 240 is about 36 inches. In other embodiments this distance is at least nineteen inches and preferably at least twenty inches. It is also within the scope of this invention for the exit end of the feed tube to be within the pipe 243. Alternatively, the chamber 240 may be deleted and the pipe 243 extended to any distance (to the right of the plate 242) within the conveyor 40 up to the impellers or to a point within them. The nose member 260 has a solid plate portion 262 and a nose In one aspect all parts 240–260 are bolted or otherwise removably connected to the conveyor for easy removal and replacement. Alternatively, they may be welded in place. FIG. 5B illustrates (with dotted lines 125*a*, 125*b*, respectively) an outer edge and an inner edge of one of the generally circular pool surface solids diffusers.

FIGS. 5B and 5C show the spaced-apart impellers 250 which are designed to radially accelerate fluid exiting the conveyor to pool surface speed to minimize pool disturbance by such feed. In another embodiment, the chamber 240 is deleted and the impellers 250 are extended toward the end of the feed tube (to the left in FIG. 5A) and, in one such embodiment, the end of the feed tube is within the impellers. Optionally, the parts related to the internal feed chamber (including mounting plate and pipe), impellers and nose member are all removably bolted to the conveyor so that they can be replaced. Alternatively, in one aspect, they are all permanently welded in place. The same drive motor transmission, driven sheave, backdrive apparatus, bearings etc. as in FIG. 2 may be used with the centrifuge of FIG. 5A.

In a typical prior art centrifuge the ratio of the internal diameter of the exit end of the feed tube to the length of free fluid travel within the conveyor (e.g. within a prior art acceleration chamber from the feed tube exit to the far end wall of the acceleration chamber) is about 4:1 or less. In certain embodiments according to the present invention this ratio is 7:1 or greater and in other aspects it is 10:1 or greater. In one particular centrifuge according to the present invention the internal feed tube exit diameter is about two and one-fourth inches and the distance from the feed tube exit to the leading edge (252) of an impeller (as in FIG. 5A) is about thirty six inches.

The present invention, therefore, provides in certain, but not necessarily all embodiments, a conveyor for a centrifuge, the conveyor having a length and a plurality of spaced-apart flight members spaced apart along the length of the conveyor, a plurality of support members (e.g. two, three, four, five or more) extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor. Such a method may include one or some of the following, in any possible combination: at least one pool surface diffuser connected to the conveyor; at least one accelerating impeller connected to the conveyor for accelerating the fluid; wherein the open areas extend along and around substantially the entire length of the conveyor or around only a part thereof; a hollow feed tube with a fluid exit end within the conveyor through which fluid to be treated by the centrifuge enters a space within the conveyor; at least one of the plurality of open areas located adjacent the fluid exit end of the feed tube; a chamber within the conveyor, part of the chamber having a fluid entry end encompassing the fluid exit end of the feed tube, the chamber for receiving fluid exiting from the fluid exit end of the feed tube, the fluid passing through the chamber and exiting a fluid passage end of the chamber, the fluid passage end spaced-apart from the chamber's fluid entry end, the fluid passage end within the conveyor; wherein the chamber is generally conical in shape with the fluid entry end smaller in diameter than the fluid passage end; wherein fluid exiting from the fluid exit end of the feed tube has an exit velocity and the fluid at the fluid passage end has a passage velocity, the exit velocity greater than the passage velocity; wherein the fluid exit end of the hollow feed tube has an internal diameter and the space within the conveyor includes an unobstructed space adjacent the feed tube fluid exit end, said space having a length, and a ratio of at least 7:1 or wherein the ratio is at least 10:1 of the internal diameter of the feed tube exit end the length of said space; at least one impeller for contacting fluid from the chamber, the impeller connected to the conveyor and for increasing the radial speed of the fluid prior to the fluid flowing out from the conveyor; wherein the at least one impeller is a plurality of spaced-apart impellers each with a central end connected to a central nose member mounted in the conveyor; wherein the impellers are for accelerating the fluid to a speed that is at least 95% of the speed of rotation of a pool of fluid to be treated in the bowl; wherein the chamber, the central nose member, and the at least one impeller are permanently secured to the conveyor; wherein the chamber, the central nose member, and the at least one impeller are removably connected to the conveyor; wherein the at least one pool surface solids diffuser is a plurality of spaced-apart pool surface solids diffusers (e.g. rings with openings therethrough); and/or the conveyor having a distal end smaller in diameter than an entry end at which fluid enters the conveyor, and at least one of the plurality of open areas at the distal end.

The present invention, therefore, provides in certain, but not necessarily all embodiments, a centrifuge including a bowl with a hollow interior and a first bowl end spaced-apart from a second bowl end, apparatus for selectively rotating the bowl, a conveyor rotatably mounted in the bowl, the conveyor comprising a plurality of spaced-apart flight members each having a length, a plurality of support members extending between and connected to the spaced-apart flight members, the support members spaced-apart around the spaced-apart flight members, and the spaced-apart flight members and the plurality of support members defining a plurality of open areas through which fluid to be treated by the centrifuge is flowable from within the conveyor apparatus for selectively rotating the conveyor, and apparatus for material entry (e.g. a feed tube) and exit (e.g. solids and liquid outlets) from the bowl. Such a method may include one or some of the following, in any possible combination: wherein the conveyor further comprises at least one pool surface solids diffuser connected to the conveyor; the conveyor having a distal end smaller in diameter than an entry end at which fluid enters the conveyor, and at least one of the plurality of open areas at the distal end; a control apparatus interconnected with the conveyor for selectively adjusting speed of rotation of the conveyor relative to the bowl; a control apparatus interconnected with the conveyor for selectively adjusting speed of rotation of the bowl relative to the conveyor; the conveyor having at least one or a plurality of accelerating impellers connected to the conveyor for accelerating the fluid; the conveyor with a hollow feed tube with a fluid exit end within the conveyor through which fluid to be treated by the centrifuge enters a space within the conveyor; the conveyor with at least one of the plurality of open areas located adjacent the fluid exit end of the feed tube; the conveyor with a chamber within the conveyor, part of the chamber having a fluid entry end encompassing the fluid exit end of the feed tube, the chamber for receiving fluid exiting from the fluid exit end of the feed tube, the fluid passing through the chamber and exiting a fluid passage end of the chamber, the fluid passage end spaced-apart from the chamber's fluid entry end, the fluid passage end within the conveyor; the conveyor with the chamber generally conical in shape with the fluid entry end smaller in diameter than the fluid passage end; the conveyor's parts configured, sized and positioned so that fluid exiting from the fluid exit end of the feed tube has an exit velocity and the fluid at the fluid passage end has a passage velocity, the exit velocity greater than the passage velocity; wherein the fluid exit end of the hollow feed tube has an internal diameter and the space within the conveyor includes an unobstructed space adjacent the feed tube fluid exit end, said space having a length, and a ratio of at least 7:1 of the internal diameter of the feed tube exit end the length of said space; the conveyor with at least one impeller for contacting fluid from the chamber, the impeller connected to the conveyor and for increasing the radial speed of the fluid prior to the fluid flowing out from the conveyor; the conveyor in which the at least one impeller is a plurality of spaced-apart impellers each with a central end connected to a central nose member mounted in the conveyor; the conveyor's impellers for accelerating the fluid to a speed that is at least 95% (or at least 99%) of the speed of rotation of a pool of fluid to be treated in the bowl; the conveyor with the chamber and the at least one impeller permanently secured to the conveyor; the conveyor with the chamber and the at least one impeller removably connected to the conveyor; the conveyor with at least one pool surface solids diffuser connected to the conveyor; the centrifuge bowl having a beach area, the conveyor further comprising the conveyor having a distal end smaller in diameter than an entry end at which fluid enters the conveyor, and at least one of the plurality of open areas adjacent the beach area so material to be treated flows out from the conveyor through said at least one of the plurality of open areas; wherein there are a plurality of open areas of the conveyor adjacent the beach area; a control apparatus interconnected with the conveyor for selectively adjusting speed of rotation of the conveyor relative to the bowl; wherein the control apparatus is a backdrive apparatus; wherein the backdrive apparatus is pneumatically powered; a control apparatus interconnected with the conveyor for selectively adjusting speed of rotation of the bowl relative to the conveyor wherein the control apparatus is a backdrive apparatus; and/or wherein the backdrive apparatus is pneumatically powered.

The present invention, therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, apparatus for selectively rotating the bowl and the conveyor and for differing rotational speed of the conveyor with respect to the bowl, apparatus for providing unfocused feed material from within the conveyor into the bowl, and apparatus for material exit from the bowl.

The present invention, therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, apparatus for selectively rotating the bowl and the conveyor and for differing rotational speed of the conveyor with respect to the bowl, apparatus for slowing down feed material within the conveyor before it exits the conveyor into the bowl, and apparatus means for material exit from the bowl.

The present invention, therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, apparatus for selectively rotating the bowl and the conveyor and for differing rotational speed of the conveyor with respect to the bowl, apparatus for diffusing solids in a pool of feed material in the bowl, and apparatus for material exit from the bowl.

The present invention, therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, rotation apparatus for selectively rotating the bowl and the conveyor and for differing rotational speed of the conveyor with respect to the bowl, apparatus for pneumatically powered control apparatus for selectively controlling the differing rotation speed of the conveyor, and apparatus for material entry and exit from the bowl.

The present invention, therefore, provides in certain, but not necessarily all embodiments, a centrifuge for separating components of a feed material, the centrifuge with a bowl with a hollow interior and a first bowl end spaced-apart from a second bowl end, the bowl having a beach area, a conveyor within the bowl for moving separated material from the first bowl end to the second bowl end, apparatus for selectively rotating the bowl and the conveyor and for differing rotational speed of the conveyor with respect to the bowl, the conveyor including a plurality of spaced-apart conveying members each having a length, a plurality of support members extending between and connected to the spaced-apart conveying members, the support members spaced-apart around the spaced-apart conveying members, and the spaced-apart conveying members and the plurality of support members defining a plurality of open areas through which fluid to be treated by the centrifuge is flowable out from within the conveyor to space between an exterior of the conveyor and an interior surface of the bowl and at least one of the open areas adjacent a portion of the beach area so that fluid to be treated by the centrifuge flows from said at least one open area to said portion of the beach area, and apparatus for material exit from the bowl.

The present invention, therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, the conveyor having a length and comprising a plurality of spaced-apart flight members spaced apart along the length of the conveyor, a plurality of support members extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor, a hollow feed tube with a fluid entry end outside the first bowl end and a fluid exit end within the conveyor through which feed material to be treated by the centrifuge enters a space within the conveyor, at least one of the plurality of open areas located further away from the first bowl end than the fluid exit end of the feed tube, apparatus for selectively rotating the bowl and the conveyor and for differing rotational speed of the conveyor with respect to the bowl, and apparatus for material exit from the bowl.

The present invention, therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, the conveyor having a length and comprising a plurality of spaced-apart flight members spaced apart along the length of the conveyor, a plurality of support members extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor, a hollow feed tube with a fluid exit end within the conveyor through which feed material to be treated by the centrifuge enters a space within the conveyor, a velocity decrease chamber in the conveyor, the fluid exit end discharging into the velocity decrease chamber within the conveyor, the velocity decrease chamber having an outer surface spaced-apart from an inner surface of the support members, apparatus for selectively rotating the bowl and the conveyor and for differing rotational speed of the conveyor with respect to the bowl, and apparatus for material exit from the bowl; and such a centrifuge with at least one of the plurality of open areas adjacent the outer surface of the velocity decrease chamber.

The present invention, therefore, provides in certain, but not necessarily all embodiments, a method for separating components of a feed material, the method introducing feed material into a centrifuge, the centrifuge like any disclosed herein according to the present invention separating components of the feed material within the centrifuge; and discharging from the bowl separated components of the feed material; and, such a method wherein the feed material includes liquid with solids entrained therein and the centrifuge separates solids from the liquid, the solids exiting from the bowl through at least one bowl solids exit port and the liquid exits from the bowl through at least one bowl liquid exit port which is spaced-apart from the bowl solids exit port; and any such method wherein the centrifuge includes a hollow feed tube with a fluid exit end within the conveyor through which fluid to be treated by the centrifuge enters a space within the conveyor, and the fluid exit end of the hollow feed tube has an internal diameter and the space within the conveyor includes an unobstructed space adjacent the feed tube fluid exit end, said space having a length, and a ratio of at least 7:1 of the internal diameter of the feed tube exit end the length of said space; and any such method wherein there is at least one impeller for contacting fluid from the chamber, the at least one impeller connected to the conveyor and for increasing the radial speed of the fluid prior to the fluid flowing out from the conveyor, wherein the at least one impeller is a plurality of spaced-apart impellers each with a central end connected to a central nose member mounted in the conveyor, and wherein the impellers accelerate the fluid to a speed that is at least 95% of the speed of rotation of a pool of fluid to be treated in the bowl and the method also includes radially accelerating with the impellers the fluid to at least 95% (or to at least 99%) of the rotational speed of the pool of fluid in the bowl prior to the fluid flowing out from the conveyor into space between the outer edge of the spaced-apart flight members and an interior surface of the bowl.

Figure 5D:
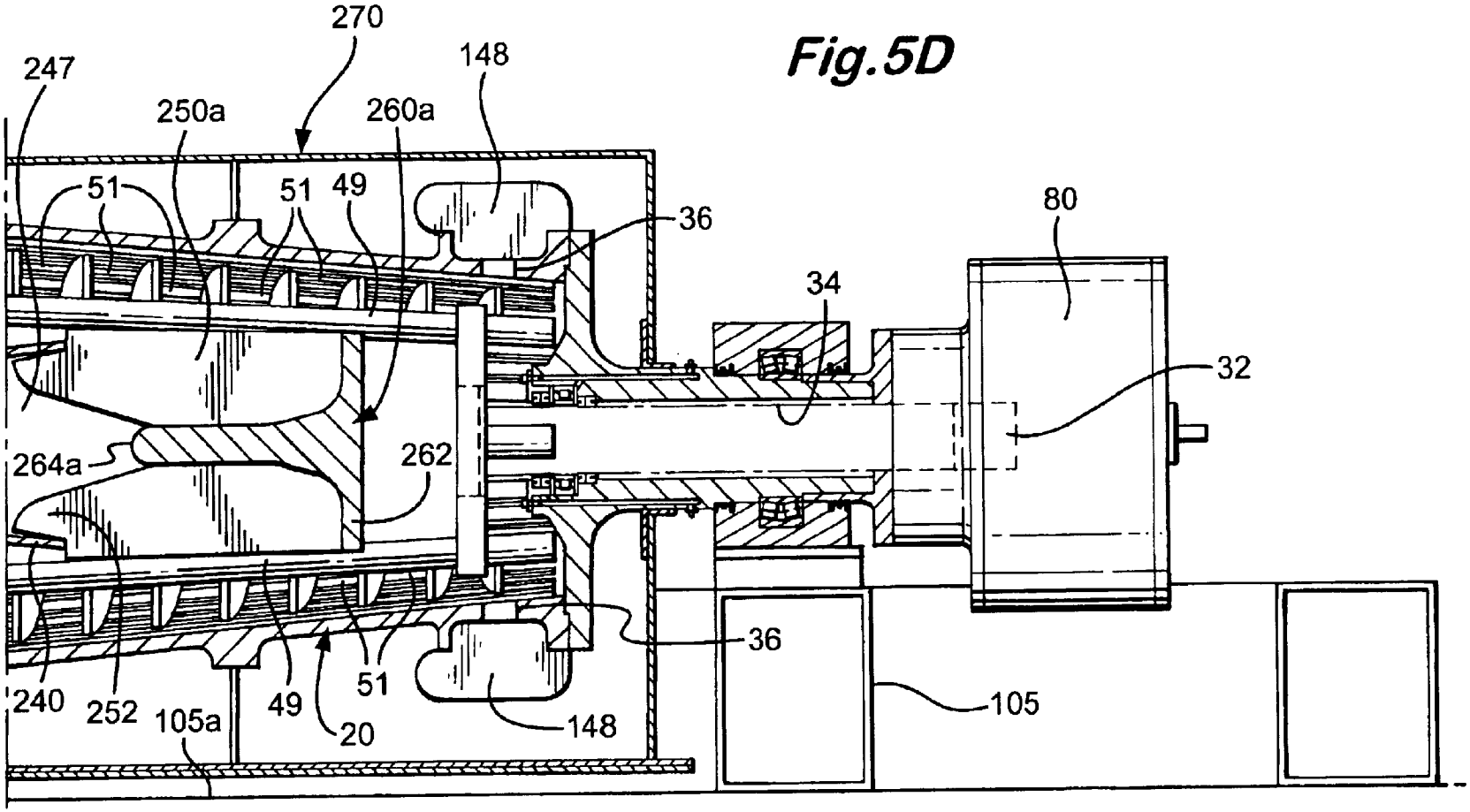
FIGS. 5D and 5E are side cross-section views of a centrifuge according to the present invention.

FIG. 5D shows a centrifuge 270 like the centrifuge 210 and like numerals indicate like parts. A nose 264*a* of a nose member 261*a* projects between the impellers 250*a* (which function like the impellers 250, FIG. 5A). The nose member 264*a* facilitates the distribution of fluid flow along the length of the impellers 250*a*. In certain aspects the length of the nose member 264*a* (the distance from the plate 262 to the distal end of the nose member 264*a*) is at least 50% of the length of the impellers 250*a*; in other aspects, at least 60% or at least 90%. The plate 262 (like other such plates herein) prevents fluid flow past the plate facilitating efficient centrifugating treatment of fluid prior to fluid exiting from a bowl exit port. The plate may, according to the present invention, be used alone without the projecting nose end part.

Figure 5E:
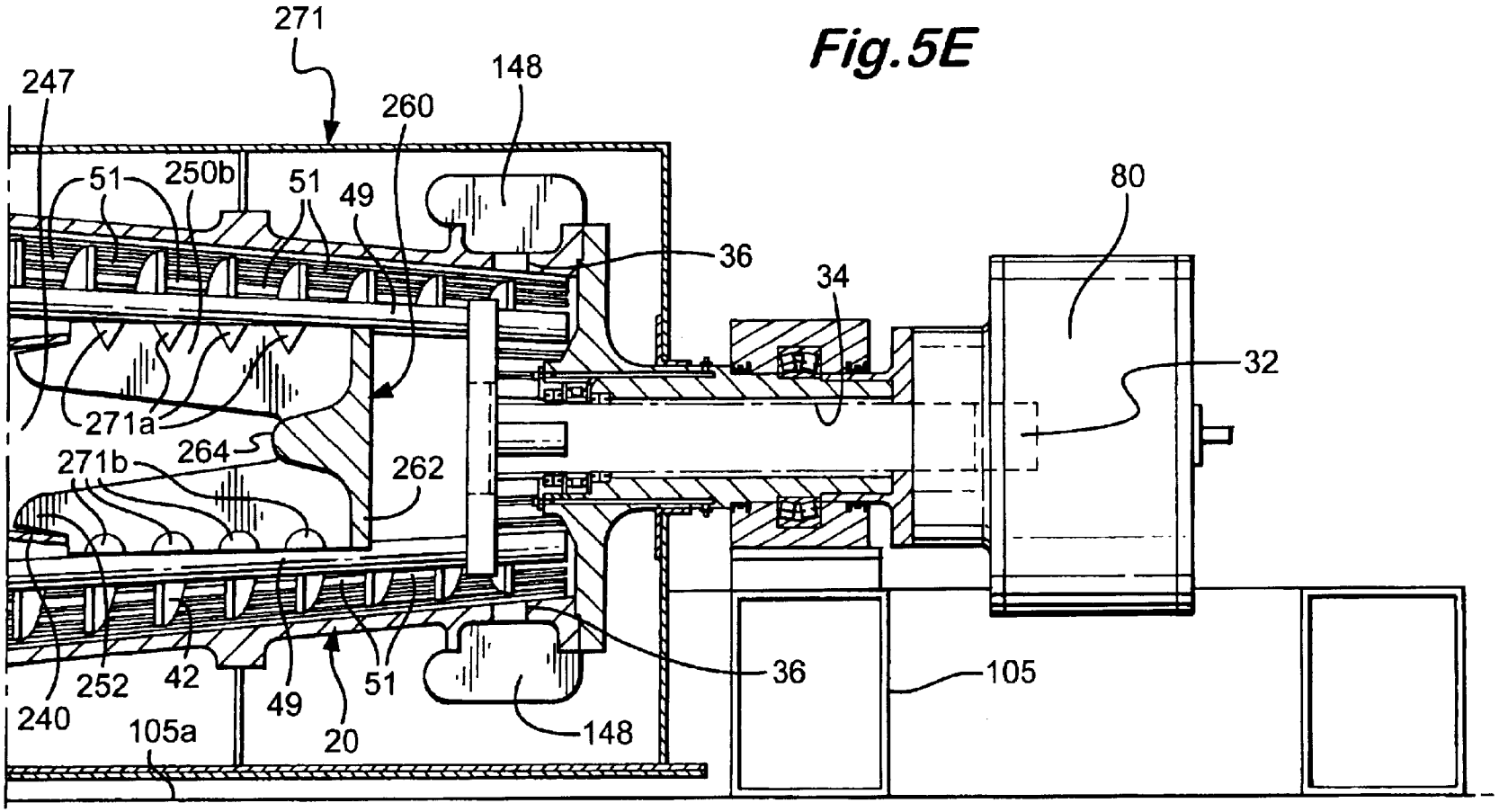

FIG. 5E shows a centrifuge 271 like the centrifuge 210 and like numerals indicate like parts. Impellers 250*b* have fixed thereto or formed thereof a plurality of spaced apart flow diverters 271*a* and/or 271*b*. These diverters 271*a*, 271*b* are positioned to prevent the direct flow of fluid against inner edges of the flights or sections 42 adjacent the impellers 250*b* to inhibit or prevent unwanted wear and abrasion of the flights or sections 42 (and of other structural members adjacent the diverters). As shown in FIG. 5E, the shape of the diverters 271*a* is, in cross-section as viewed in FIG. 5E, generally triangular and that of the diverters 271*b* is generally semi-circular; but it is within the scope of this invention for such diverters to have any desired shape, including, but not limited to, square, rectangular, trapezoidal, etc. Such diverters can be used at any point adjacent any flight member of a conveyor according to the present invention.

It is to be understood that although the centrifuges 270, 271 are not shown in their entirety in FIGS. 5D, 5E, respectively, that they are substantially like the centrifuge 210 (with the noted differences). A nose member 264*a* may, according to the present invention, be used with any accelerator or impeller apparatus, including, but not limited to, any of those disclosed herein; or such a nose member may be used, according to the present invention, without accelerator or impeller apparatuses. Alternatively, the nose member 264*a* (and any nose member disclosed herein) may be used in any centrifuge according to the present invention, with or without accelerating impellers and/or in any centrifuge with or without a conveyor; and with or without a conveyor as disclosed herein. Diverters as in the centrifuge 271 may, according to the present invention, be used with any impeller, including, but not limited to, those disclosed herein. All the diverters for all impellers of an accelerator may be like the diverters 271*a*, or 271*b*, or like any diverters disclosed herein. As shown in FIG. 6A the diverters are secured to or formed of the impellers; but it is within the scope of the present invention to position the impellers, or any of them, on the structural members of a conveyor rather than on the impellers, or on both the impellers and on the structural members of a conveyor. In certain aspects the diverters are secured to or formed of either an inner edge of a conveyor flight or secured to or formed of rods 49 (FIG. 4A) or other structural parts of the conveyor.

FIGS. 6A–6D show an accelerator 280 according to the present invention [for a centrifuge which may be a centrifuge as in FIGS. 5A–8C or may be a centrifuge, according to the present invention, but which has no conveyor] which has four curved impellers 281 (curved as viewed in FIG. 6B or FIG. 5B) each with a plurality of flow diverters 282. A nose member 283 has a nose 284 that projects between the impellers 281. Optionally, the nose member is deleted. As with the diverters 271*a*, 271*b*, FIG. 5E, the diverters 282 direct fluid flow away from flights or sections of a conveyor adjacent the impellers to reduce wear of the flights or sections. The diverters 281 are thinner (as viewed in FIG. 6B) at a front end 281*a* thereof and thicker at a rear end 281*b* thereof; although it is within the scope of the present invention for them to be a uniform thickness from front to rear. The accelerator 280 (and any accelerator according to the present invention) preferably, in certain aspects, accelerates fluid to about 110% of the speed of a conveyor in which the accelerator is used.

FIG. 6F shows diverters 282*a*, like the diverters 282, FIG. 6D, but on a rod 49 of a conveyor (like the conveyor of FIG. 5A; but which may be any conveyor according to the present invention).

FIG. 6E shows an alternative shape (viewed from above) for diverters 285 according to the present invention useful with any impeller; but, according to the present invention, they may have any desired shape.

Figure 7A:
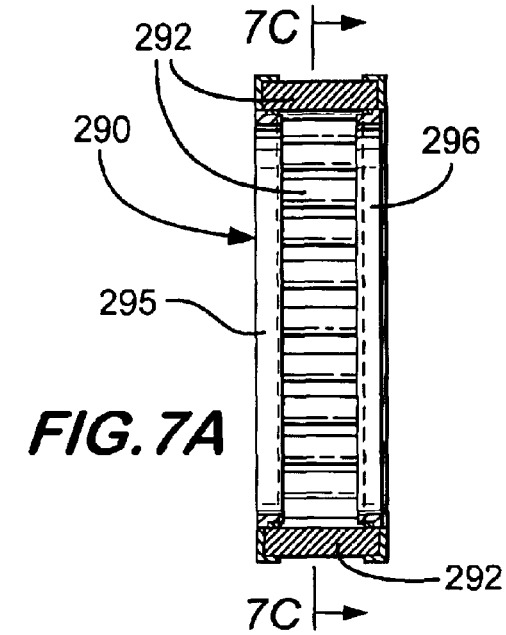
FIG. 7A is a side cross-section view of a flow enhancer according to the present invention for centrifuges.
Figure 7B:
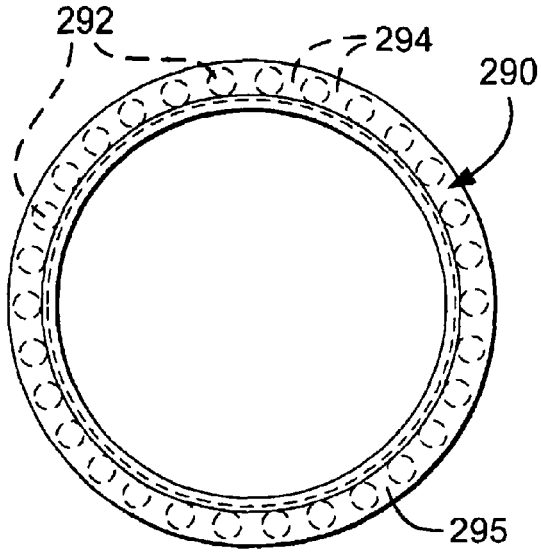
FIG. 7B is an end view of the flow enhancer of FIG. 7A.
Figure 7C:
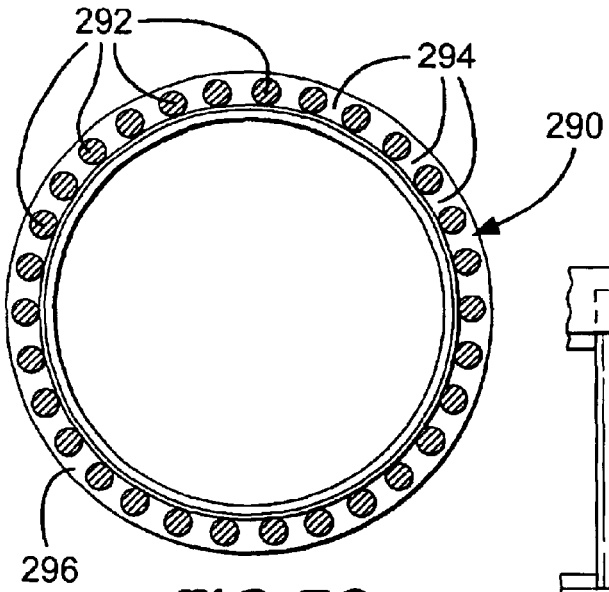
FIG. 7C is a cross-section view along line 7C—7C of FIG. 7A.
Figure 7D:
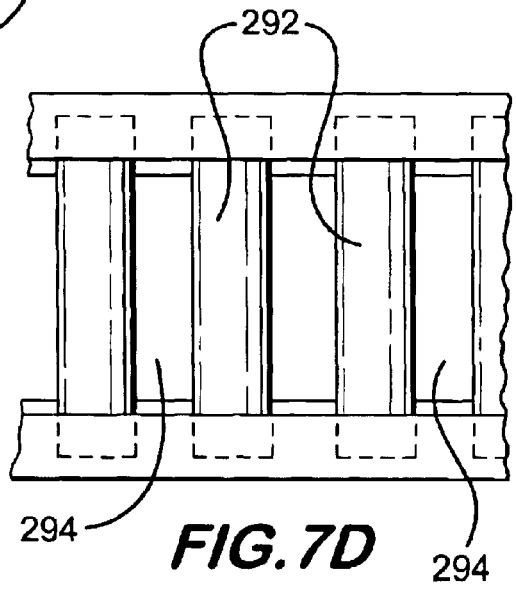
FIG. 7D is a partial top view of the flow enhancer of FIG. 7B.
Figure 7E:
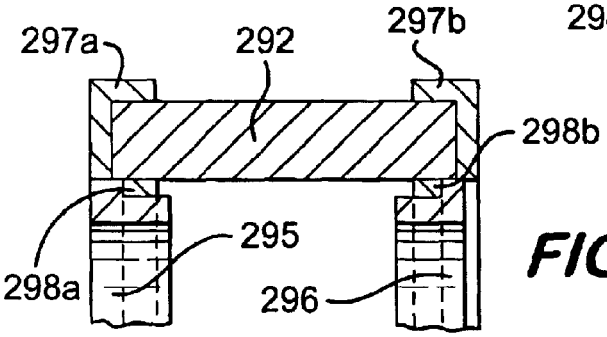
FIG. 7E is an enlarged view of part of the flow enhancer of FIG.
Figure 7F:
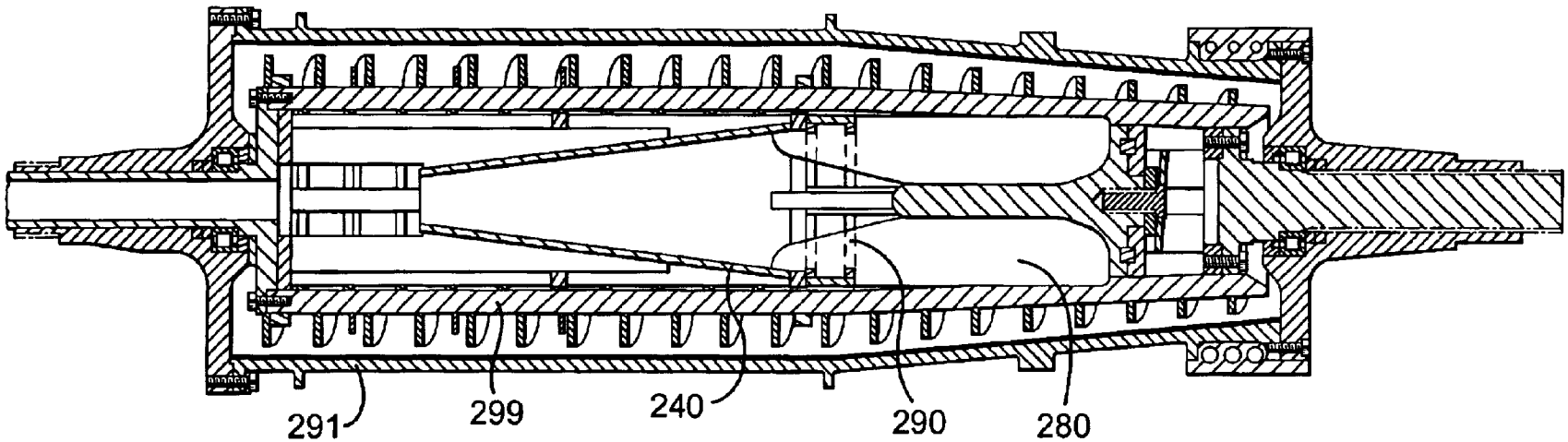
FIG. 7F is a side view in cross-section of a centrifuge with a flow enhancer as in FIG. 7A.

FIGS. 7A–7E show a flow enhancer 290 according to the present invention which, as shown in FIG. 7F is usable with (or without) an accelerator according to the present invention with impellers as described herein (and may be used with any accelerator or impeller apparatus disclosed herein). The flow enhancer 290 has a plurality of spaced-apart pins 292 which are contacted by fluid flowing from the feed tube and which accelerate this fluid. Fluid may flow through a central opening 293 of the flow enhancer 290 and through openings 294 between the pins 292 and a front ring 295 and a rear ring 296. FIG. 7E shows an optional securement for securing the pins 292 to the rings 295, 296. Each pin's ends are encompassed by tungsten carbide wear plates 297*a*, 297*b* and tungsten carbide parts 298*a*, 298*b* are positioned beneath the wear plates. In one particular embodiment the pins 292 have a circular cross-section with a ⅜" diameter, a length of 3" and they are spaced apart from each other about ½", with rings about 11.5" in diameter with central openings about 10" in diameter. A flow enhancer 290 according to the present invention is useful, inner alia, when a centrifuge is used in a "low flow" mode: e.g. a flow rate of less than one hundred gallons per minute; but it is within the scope of this invention to use such a flow enhancer in any centrifuge at any desired flow rate. Although the flow enhancer 290 as shown has 32 pins 292, any desired number of such pins (e.g. but not limited to 10, 20, 25, 30, 35 or more), of any desired cross-sectional shape (e.g. triangular, square, semicircular, circular, rectangular, trapezoidal, pentagular, etc.) may be used. FIG. 7F shows a centrifuge (like the parts of centrifuge 271, FIG. 5A) bowl 291 and conveyor 292 according to the present invention (like the parts of centrifuge 271, FIG. 5A) (which may be any bowl and conveyor disclosed herein according to the present invention) with an accelerator 280 (FIG. 6A) and a flow enhancer 290.

In the centrifuges 210, 271, 271, due to the length and position of the conical chamber 240 (which may, according to the present invention, also be cylindrical), feed to the centrifuge exits the chamber 240 at the beach end area of the bowl. Optionally, the chamber 240 may be deleted and fluid flows out from the conveyor at locations in addition to those adjacent the beach area.

Figure 8A:
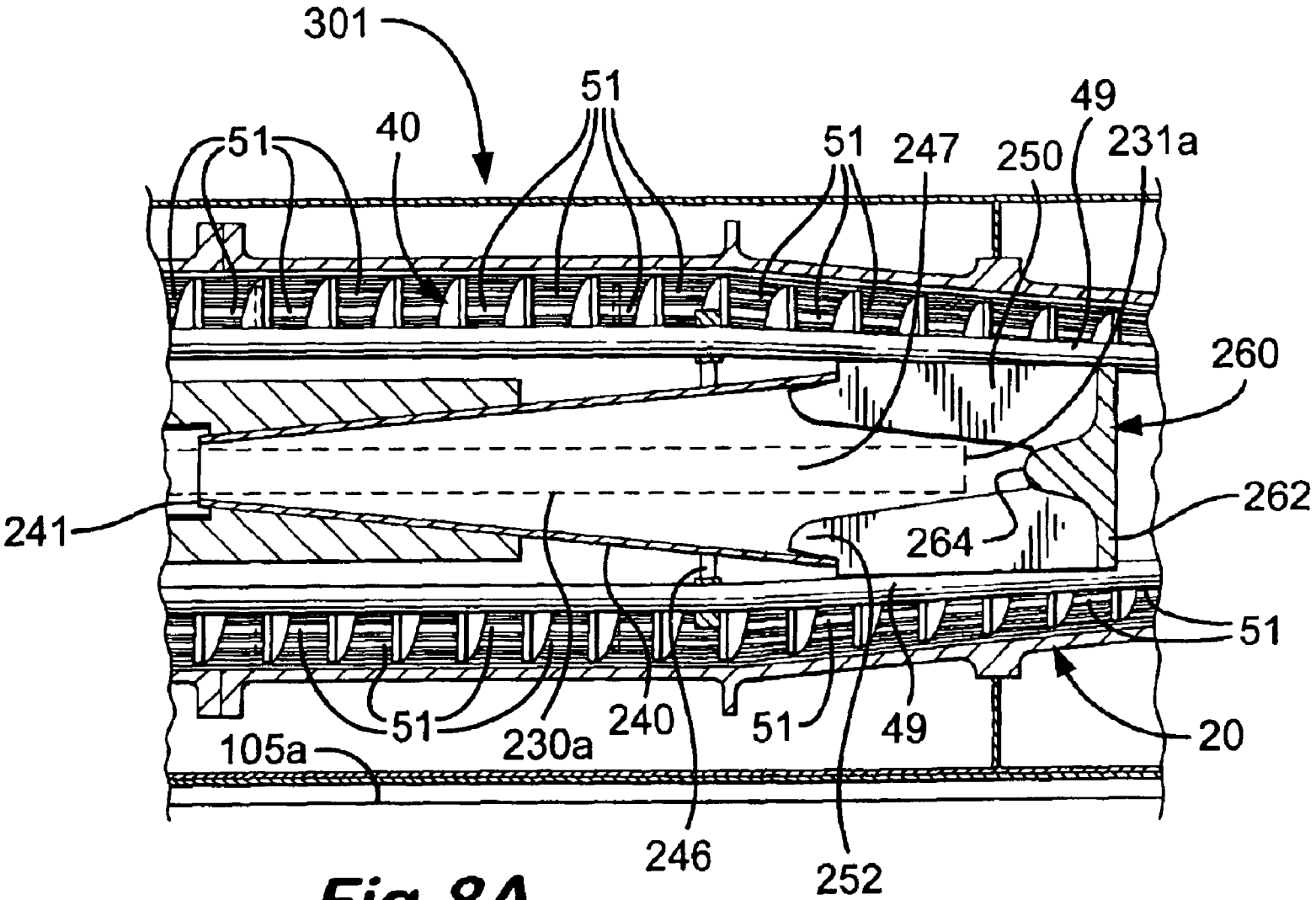
FIGS. 8A–8E are side cross-sectional views of centrifuges according to the present invention.

FIG. 8A shows a centrifuge 301 (partially) according to the present invention, which is like the centrifuge 210, FIG. 5, and like numerals indicate like parts (it is to be understood that the unshown remainder of the centrifuge 301 is like the remainder of the centrifuge 210, FIG. 5A). A feed tube 230*a*, similar to the feed tube 230, FIG. 5A) has an exit end 231*a* adjacent the end of the nose member 264 so that fluid to be treated exits within impellers 250. It is within the scope of this invention to employ a feed tube of any desired length with an exit end located longitudinally at any point adjacent the impellers 250 or at any point in the chamber 240; and to use a feed tube (and for any feed tube disclosed herein) of any desired internal and external diameter.

Figure 8B:
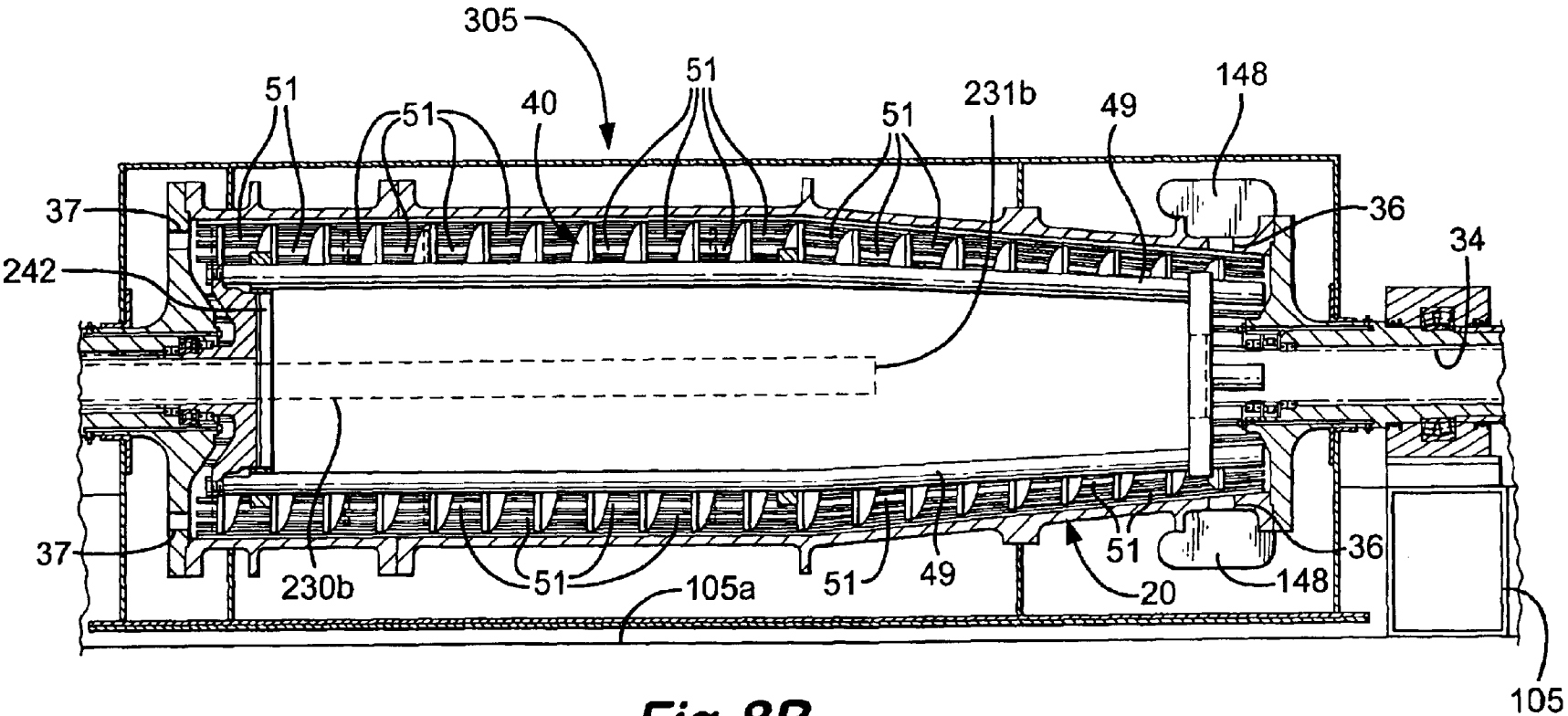

FIG. 8B shows a centrifuge 305 (partially) according to the present invention, which is like the centrifuge 210, FIG. 5A, and like numerals indicate like parts (it is to be understood that the unshown remainder of the centrifuge 301 is like the remainder of the centrifuge 210, FIG. 5A). The centrifuge 305 has no chamber like the chamber 240. The centrifuge 305 has a feed tube 230*b*, like the feed tube 230, FIG. 5A, but of longer length. The feed tube 230*b* has a fluid exit end 231*b* which is longitudinally adjacent a part of the beach area of the bowl 20. It is within the scope of this invention for the feed tube 230*b* (and any feed tube disclosed herein) to be of any desired length and, in certain aspects, for the feed tube's fluid exit to be adjacent any point on the beach area or a point not on the beach area.

Figure 8C:
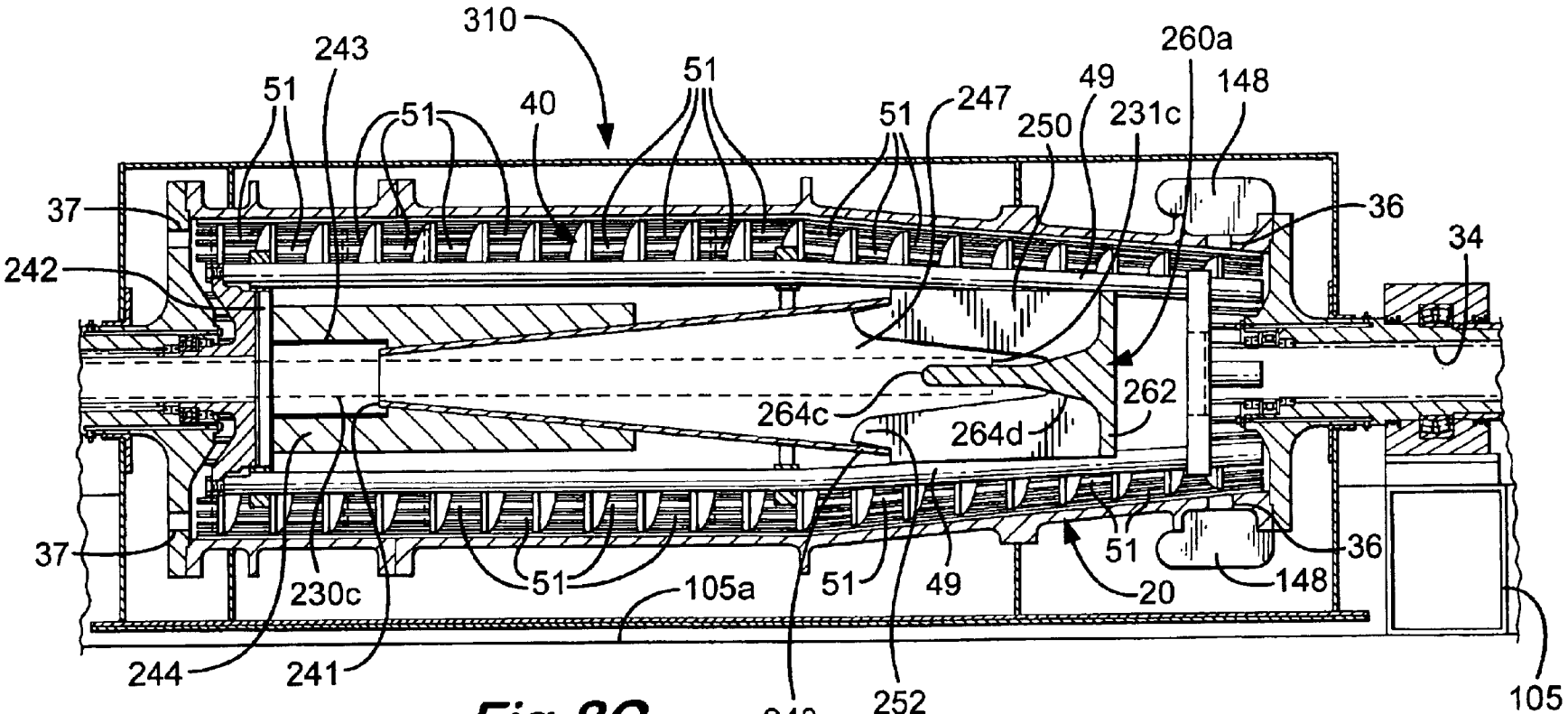
Figure 8D:
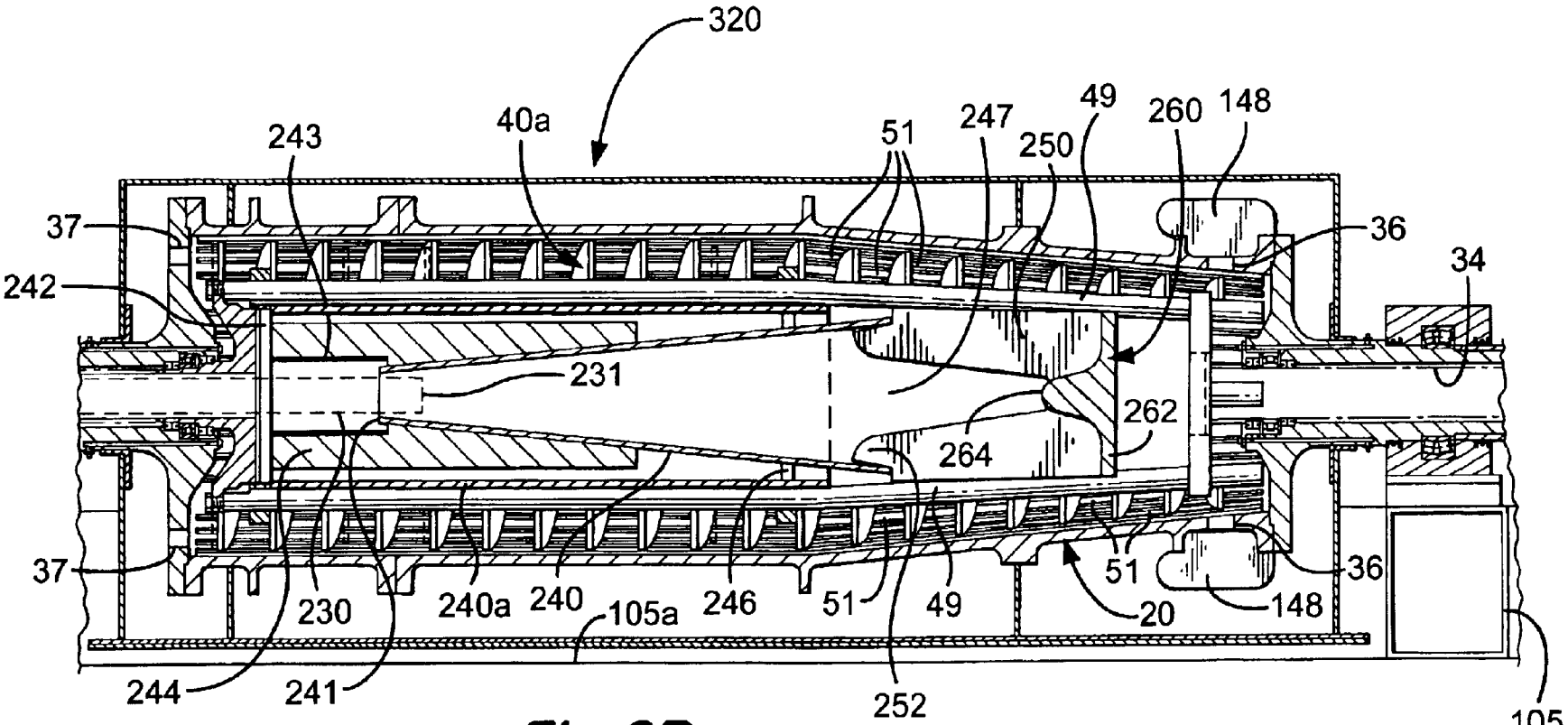

FIG. 8C shows a centrifuge 310 (partially) according to the present invention, which is like the centrifuge 210, FIG. 5A, and like numerals indicate like parts (it is to be understood that the unshown remainder of the centrifuge 301 is like the remainder of the centrifuge 210, FIG. 5A). The centrifuge 310 has a feed tube 230*c*, like the feed tube 230, FIG. 5A, but of longer length. The feed tube 230*c* has a fluid exit end 231*c* into which projects an end 264*c* of a nose member 264*d* which has a plate 260*a* like the plate 260, FIG. 5A. It is within the scope of this invention to use a nose end of any size and diameter (and of any desired cross-sectional shape, including, but not limited to circular, triangular, square, rectangular, trapezoidal, pentagonal, or hexagonal) and of any length; and any such nose end may project any desired distance into a feed tube exit end.

In certain embodiments of the present invention, the turbulence associated with prior art centrifuges due to the relatively high velocity of fluid exiting from a conveyor's feed ports into a bowl is reduced or substantially eliminated. With centrifuges according to the present invention, e.g. as in FIGS. 5A, 5D, 5E and 7E, accelerated feed is introduced at bowl's beach end (primarily or only) which allows the fluid stream to enter the bowl above or in a relatively shallow pool and solids are deposited at or near the bottom of the shallow pool and they do not have to settle through the main pool body. By spreading fluid feed over a relatively larger area, turbulent jetting effects associated with prior art feed ports that focus feed are reduced or eliminated. In some prior art machines some solids separated between feed zones and a liquid effluent end must pass through a turbulent area, compromising their separation. Using conveyors according to the present invention, high velocity axial fluid feed is converted to radial motion and the feed is spread over the width and length of the impellers; and the tangential speed of the fluid is increased slightly faster than the speed of the pool surface caused by bowl rotation, thus allowing the feed to fall into the bowl with reduced or no turbulence. Also, by feeding at a bowl beach area, the distance solids need to travel to reach a bowl wall is reduced and transport of solids to a solids discharge port is enhanced; and thus solids removal is not so dependent on fluid retention time. A thin sheet of fluid feed material slides off the faces of the impellers and is deposited axially along the length of the beach. Depending on the pool depth being used, some of the thin sheet of accelerated feed material enters the leading edge of the pool, some enters at the transition of the pool to the beach and the balance enters on the dry beach. As this thin layer comes in contact with the bowl wall or pool surface it is already accelerated to the full or nearly-full G-force. Solids particles have only to move through the fluid that they entered with to be discharged. Allowing much of the separation to occur on the beach reduces the amount of solids that normally would be held and transported from the cylinder section of the bowl; thus lowering torque, reducing the amount of solids held in the bowl and reducing the work load of the gearbox.

The centrifuge 320 according to the present invention is like the centrifuge 210, described above; but it also has an inner cylindrical shell 240*a* that closes off the conveyor from the fluid entry end (to the left in FIG. 8D) of the centrifuge up to the bowl's beach area. Thus fluid flowing out from the chamber can only exit from the conveyor adjacent the far end (to the right in FIG. 8D) of the bowl and the only open areas 51 are at this far end of the conveyor. It is within the scope of the present invention to employ a shell 240*a* of any desired length and thus to close off any opening 51 or openings 51 in the centrifuge 210 of FIG. 5A or openings of any conveyor according to the present invention. In the centrifuge 320, the chamber 240 may be deleted. It is to be understood that the items and structures of the centrifuge 210 not shown in FIG. 8A may be used with the centrifuge 320 (or similar items and structures—as is true for the centrifuges 270, 271, 291, 301, 305, and 310).

The present invention, therefore, in at least certain embodiments, provides a conveyor for a centrifuge, the conveyor having a length and having a plurality of spaced-apart flight members spaced apart along the length of the conveyor, a plurality of support members extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor, the open areas along substantially all of the length of the conveyor or along only a selected portion or portions of the conveyor's length, and at least one accelerating impeller within and connected to the conveyor for accelerating fluid to be treated by the centrifuge. Such a conveyor may have one or some (in any possible combination) of the following: a hollow feed tube with a fluid exit end within the conveyor through which fluid to be treated enters a space within the conveyor, the tube of any desired length and with an exit end at any desired location in the conveyor; wherein substantially all of the fluid to be treated is acceleratable by the at least one accelerating impeller or by multiple spaced-apart impellers; wherein the at least one accelerating impeller is a plurality of radially spaced-apart impellers; a chamber within the conveyor, part of the chamber having a fluid entry end adjacent the fluid exit end of the feed tube, and in one aspect the fluid exit end of the feed tube projecting into the chamber, the chamber for receiving fluid exiting from the fluid exit end of the feed tube, the fluid passing into the chamber and exiting therefrom; the at least one accelerating impeller positioned within the chamber; a central nose member within the conveyor and wherein the at least one accelerating impeller is a plurality of spaced-apart impellers each connected to the central nose member; the chamber, the central nose member, and/or the at least one impeller are permanently secured to the conveyor or are removably connected to it; the impellers having an impeller length and the nose member has a nose end with a nose end length, the nose end length at least fifty percent, sixty percent, or ninety percent of the impeller length wherein the nose member has a nose end and a plate secured to or formed of the nose member, the nose end projecting away from the plate, the plate extending across an inner space of the conveyor to prevent fluid from flowing past the plate; wherein the nose member has a curved surface to facilitate fluid flow in a direction out from the conveyor; wherein the at least one accelerating impeller has at least one flow diverter thereon for diverting fluid that contacts the flow diverter; wherein the at least one flow diverter is positioned so that a flight member of the plurality of spaced-apart flight members is adjacent the at least one flow diverter and the at least one flow diverter is able to divert fluid away from said flight member; wherein the at least one flow diverter is a plurality of flow diverters, each of the plurality of flow diverters positioned so as to divert fluid flow from a flight member of the plurality of spaced-apart flight members; wherein the conveyor has a conveyor end area positionable adjacent a beach end area of a centrifuge bowl and wherein the hollow feed tube is so configured and of sufficient length that the fluid to be treated exits the hollow feed tube adjacent the conveyor end area of the conveyor for flow to a beach end area of a centrifuge bowl; wherein the at least one accelerating impeller has a shape, viewed on end, that comprises a flowing curve extending out from a central first part of the conveyor and with a distal end on the conveyor at a radially spaced-apart location from the central first part (e.g., as in FIG. 5B); wherein the at least one accelerating impeller has a front end with a first width, viewed on end, and a rear end with a second width, the first width less than the second width; wherein the at least one accelerating impeller is a plurality of spaced-apart impellers, each impeller spaced apart about ninety degrees, each of the plurality of spaced-apart impellers having a first part at a center of the conveyor and a distal end adjacent one of the plurality of spaced-apart flight members, the first part of one impeller substantially diametrically aligned with the distal end of a next-adjacent impeller (e.g., as in FIG. 5B); a flow enhancer connected to the at least one accelerating impeller, the flow enhancer for facilitating fluid flow out from the conveyor, the flow enhancer including ring apparatus, a plurality of spaced-apart pins secured to the ring apparatus, the plurality of pins spaced-apart to define fluid flow passages therebetween, the ring apparatus having a central opening through which fluid is flowable, fluid flowable through said central opening to the at least one accelerating impeller; and/or ring apparatus that includes a first ring and a second ring, the first ring spaced-apart from the second ring by the pins of the plurality of pins, the pins of the plurality of pins secured to the first ring and the second ring and extending between the first ring and the second ring.

The present invention, therefore, in at least certain embodiments, provides a centrifuge having a bowl with a hollow interior and a first bowl end spaced-apart from a second bowl end, apparatus for selectively rotating the bowl, a conveyor rotatably mounted in the bowl, the conveyor comprising a plurality of spaced-apart flight members spaced apart along the length of the conveyor, a plurality of support members extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor, and at least one accelerating impeller within and connected to the conveyor for accelerating the fluid. Such a centrifuge may have a flow enhancer connected to the at least one impeller for facilitating fluid flow out from the conveyor, the flow enhancer connected to the at least one accelerating impeller, the flow enhancer for facilitating fluid flow out from the conveyor, the flow enhancer including ring apparatus, a plurality of spaced-apart pins secured to the ring apparatus, the plurality of pins spaced-apart to define fluid flow passages therebetween, the ring apparatus having a central opening through which fluid is flowable, fluid flowable through said central opening to the at least one accelerating impeller.

The present invention, therefore, in at least certain embodiments, provides a flow enhancer for a centrifuge, including, but not limited to, for decanting centrifuges, the flow enhancer connectable to any suitable structural part of a centrifuge, and in one aspect connectible to at least one accelerating impeller, the flow enhancer for facilitating fluid flow out from a bowl, a conveyor, or a centrifuge's interior, the flow enhancer including ring apparatus, a plurality of spaced-apart pins secured to the ring apparatus, the plurality of pins spaced-apart to define fluid flow passages therebetween, the ring apparatus having a central opening through which fluid is flowable, fluid flowable through said central opening. Such a flow enhancer may have ring apparatus that includes a first ring and a second ring, the first ring spaced-apart from the second ring by the pins of the plurality of pins, the pins of the plurality of pins secured to the first ring and the second ring and extending between the first ring and the second ring. The present invention also provides a centrifuge having a bowl with a hollow interior and a first bowl end spaced-apart from a second bowl end, apparatus for selectively rotating the bowl, and such a flow enhancer; and such a centrifuge may have a conveyor within the bowl and the flow enhancer is within the conveyor.

The present invention, therefore, in at least certain embodiments, provides: a nose member for a centrifuge, including, but not limited to for a decanting centrifuge, the nose member having a nose end and, optionally, a plate secured to or formed of the nose member, the nose end projecting away from the plate, the plate extending across an inner space of the conveyor to prevent fluid from flowing past the plate, and the nose member with a curved surface to facilitate fluid flow in a direction out from the conveyor; and a centrifuge with such a nose member.

The present invention, therefore, in at least certain embodiments, provides: an accelerator apparatus for accelerating fluid in a housing or in a centrifuge bowl of a centrifuge, the accelerator apparatus having at least one accelerating impeller for accelerating fluid to be treated, and wherein the at least one accelerating impeller has a shape, viewed on end, that comprises a flowing curve extending out from a first part of a center of the accelerator apparatus and with a distal end at an area radially spaced-apart from said first part. Such an accelerator apparatus may have one or more accelerating impellers, each with front width, viewed one end, at a first end of the accelerator apparatus and a second width at a rear end, the first width less than the second width; and/or a plurality of spaced-apart impellers, each impeller spaced apart from adjacent impellers, each of the plurality of spaced-apart impellers having a first central end and a distal end radially spaced-apart from the first end, the first end of one impeller substantially diametrically aligned with the distal end of a next-adjacent impeller. A centrifuge is provided, according to the present invention, which has such accelerator apparatus.

The present invention, therefore, in at least certain embodiments, provides: a centrifuge having a bowl with a hollow interior and a first bowl end spaced-apart from a second bowl end, the bowl having a beach area, apparatus for selectively rotating the bowl, a conveyor rotatably mounted in the bowl, the conveyor like any disclosed herein, and in one aspect the conveyor with a plurality of spaced-apart flight members spaced apart along the length of the conveyor, a plurality of support members extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor, and a feed tube for introducing fluid to be treated by the centrifuge into the conveyor, the feed tube having an exit end within the conveyor, the exit end adjacent a portion of the beach area of the bowl.

The present invention, therefore, in at least certain embodiments, provides: a conveyor for a centrifuge, the conveyor having a length and having a plurality of spaced-apart flight members spaced apart along the length of the conveyor, a plurality of support members extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor, and the plurality of open areas located so that in use the conveyor is positionable so that fluid flows out from the plurality of open areas adjacent a beach area of a centrifuge bowl or housing, and in one aspect, flows out only at a beach area.

The present invention, therefore, in at least certain embodiments, provides: a centrifuge having a bowl with a hollow interior and a first bowl end spaced-apart from a second bowl end, the bowl having a beach area at a beach end of the centrifuge, apparatus for selectively rotating the bowl, a conveyor rotatably mounted in the bowl, the conveyor like any disclosed herein and in one aspect with a plurality of spaced-apart flight members spaced apart along the length of the conveyor, a plurality of support members extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor, and the plurality of open areas at the beach end of the centrifuge.

The present invention, therefore, in at least certain embodiments, provides: a method for separating components of a feed material, the method including introducing feed material into a centrifuge, the centrifuge with a bowl with a hollow interior and a first bowl end spaced-apart from a second bowl end, apparatus for selectively rotating the bowl, optionally a conveyor rotatably mounted in the bowl, the conveyor like any disclosed herein and in one aspect with a plurality of spaced-apart flight members spaced apart along the length of the conveyor, a plurality of support members extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor, and at least one accelerating impeller within and connected to the conveyor for accelerating the fluid, separating components of the feed material within the centrifuge, and discharging from the bowl separated components of the feed material. Such a method may include: wherein the feed material includes liquid with solids entrained therein and the centrifuge separates solids from the liquid, the solids exiting from the bowl through at least one bowl solids exit port and the liquid exiting from the bowl through at least one bowl liquid exit port which is spaced-apart from the bowl solids exit port; and/or wherein the at least one accelerating impeller is a plurality of radially spaced-apart impellers each with a central end connected to a central nose member mounted in the conveyor, and wherein the impellers accelerate the fluid to a speed that is at least 95% of the speed of rotation of a pool of fluid to be treated in the bowl, and the method further including radially accelerating with the impellers the fluid to at least 95% of the rotational speed of the pool of fluid in the bowl prior to the fluid flowing out from the conveyor into space between the outer edge of the spaced-apart flight members and an interior surface of the bowl.

Figure 8E:
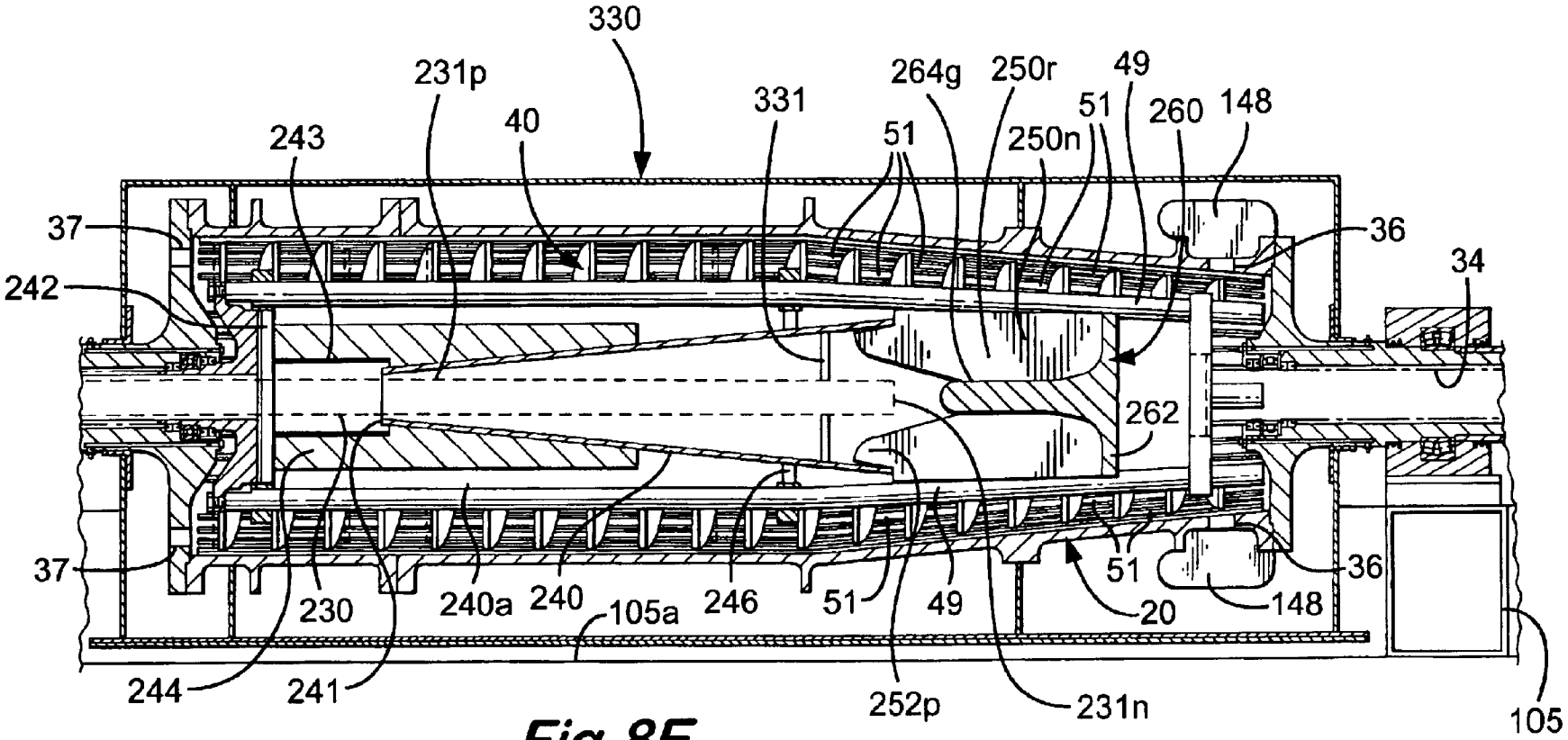

FIG. 8E shows a centrifuge 330 according to the present invention which is like the centrifuge 210, described above, and like numerals indicate like parts; and it is to be understood that portions and parts of the centrifuge 210 that are not shown in FIG. 8E may be used with the centrifuge 330 (as is true for the centrifuges of FIGS. 8A–8D, 8F and 8G). The centrifuge 330 has a feed tube 231*p* with a fluid exit end 231*n* that is positioned within forward end portions 252*p* of an accelerator 250*n* with impellers 250*r* (which are similar to the impellers 250 described above). The fluid exit end 231*n* of the feed tube 231*p* is spaced apart from an end of a nose member 264*g*. This positioning of the fluid exit end of the feed tube is, in certain aspects, advantageous because a large portion (and in certain aspects substantially all) of the fluid that exits the feed tube impacts the nose member 264*g* prior to being accelerated by the impellers 250*r*, thus limiting the areas impacted by the full force of the fluid. Also such positioning results in most of the fluid contacting the impellers, thereby increasing system efficiency. The feed tube 231*p* may be one integral continuous hollow tubular member (made e.g. of metal, fiberglass, or composite material) or, optionally, it may be made up of a plurality of pieces welded epoxied, and/or threaded together. A plate 331 connected to the chamber 240 supports the feed tube 231*p*.

Figure 8F:
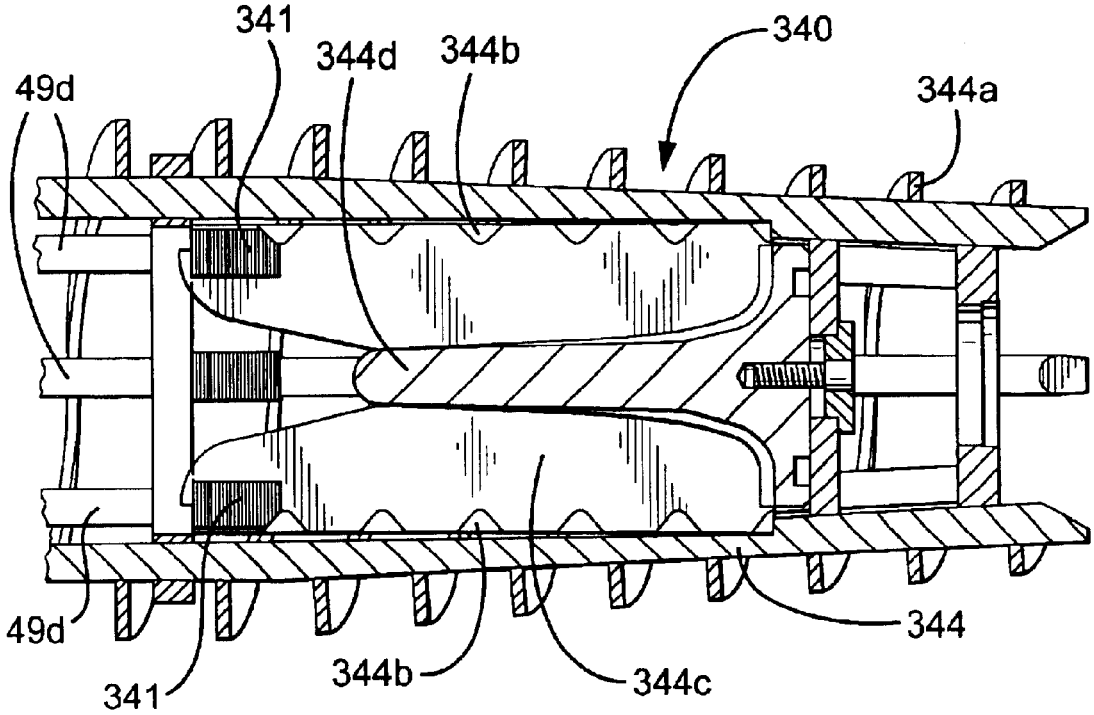
FIGS. 8F and 8G are partial cross-section views of centrifuges according to the present invention.

FIG. 8F shows a centrifuge 340 according to the present invention which has wear protectors 341 placed on rods 49*d* (like the rods 49, FIG. 2A). The wear protectors 341 are, in certain aspects, positioned at areas of increased fluid flow (e.g. near or adjacent a fluid exit end of a feed tube) which are subjected to increased abrasive and/or erosive force by the fluid. The centrifuge 340 has a conveyor 344 (which may be like any conveyor described herein) with blades or flights 344*a*, flow diverters 344*b*, and accelerator apparatus 344*c* with nose member 344*d*.

Figure 8G:
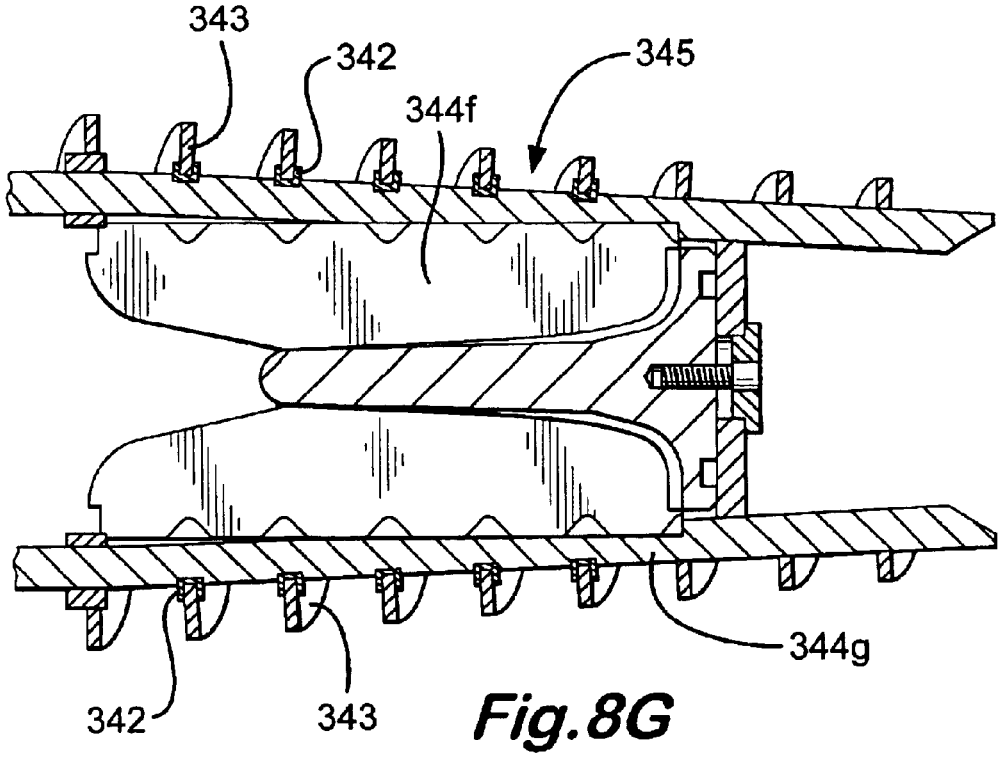

Optionally, as shown in FIG. 8G, wear protectors 342 are placed on portions of blades or flights 343 (like the flights of sections 42, FIG. 2A) of a centrifuge 345 according to the present invention and are, in certain aspects, positioned at areas on the blades or flights 343 which are subjected to and impacted by relatively high fluid flow and corresponding abrasive and/or erosive fluid force. The accelerator 344*f* is like the accelerator apparatus 344*c*, FIG. 8F, and a conveyor 344*g* is like the conveyor 344, FIG. 8F.

The wear protectors 341 and 342 may be held in position by a friction fit; a suitable adhesive, e.g. epoxy adhesive; and/or welded in place. The wear protectors 341 may be like that of FIGS. 11A–11B. The wear protectors and shields shown in FIGS. 8F, 8G, and 9A–11B may be used on any centrifuge blades and/or rods or support members, including, but not limited to, blades (flights) and rods of centrifuges according to the present invention.

Figure 9A:
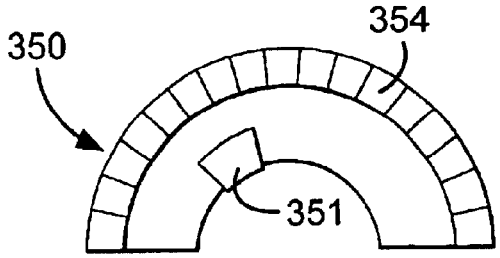
FIGS. 9A and 9B are partial views of blades or flights for centrifuges according to the present invention.
Figure 9B:
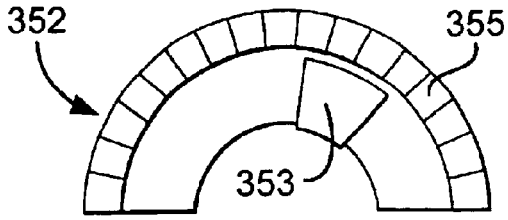
Figure 10A:
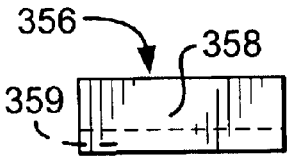
FIG. 10A is a side view of a protector according to the present invention.

FIGS. 9A and 9B show, respectively, blade 350 with a wear protector 351 and blade 352 with a wear protector 353 (of the general shape and configuration of the wear protector of FIG. 10A). Each blade has a plurality of edge tiles 354, 355, respectively, e.g. made of tungsten carbide material, which can be adhered to the rods and/or welded and/or tack welded to the rods. The wear protectors 343 may be like those of FIG. 9A, 9B or 10A.

Figure 10B:
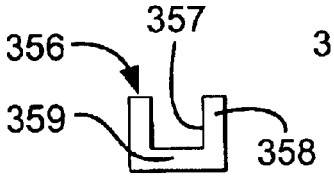
FIG. 10B is a cross-sectional view of the protector of FIG. 10A.
Figure 10C:
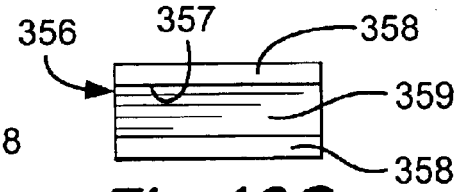
FIG. 10C is a top view of the protector of FIG. 10A.

FIGS. 10A–10C show a wear protector 356 according to the present invention which has a central recess 357 between two side portions 358 with a bottom 359. The recess 357 is sized and configured for receiving a portion of a blade or other member for emplacement thereon. The wear protector 356, as with any wear protector or shield according to the present invention, may have any desired dimensions and be shaped and sized for any rod, blade or other member.

Figure 11A:
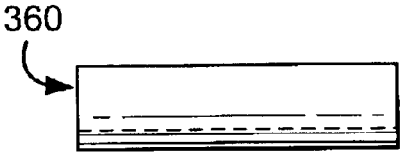
FIG. 11A is a side view of a protector according to the present invention.
Figure 11B:
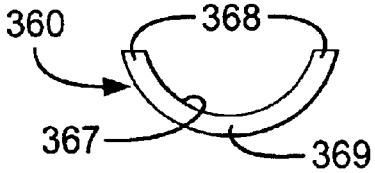
FIG. 11B is a cross-sectional view of the protector of FIG. 11A.

FIGS. 11A and 11B show a wear shield 360 according to the present invention which has a central recess 367 between two portions 368 with a bottom 369. The recess 367 is sized and configured for receiving a portion of a rod or other member for emplacement thereon. The wear shield 360, as with any wear protector or shield according to the present invention, may have any desired dimensions and be shaped and sized for any rod, blade or other member.

Wear protectors according to the present invention (e.g. but not limited to those shown in FIGS. 8F–11B) may be made of hard metal (e.g. with a Rockwell hardness of forty or more) composite, tungsten carbide, sintered tungsten carbide, or sintered ceramic.

Figure 12A:
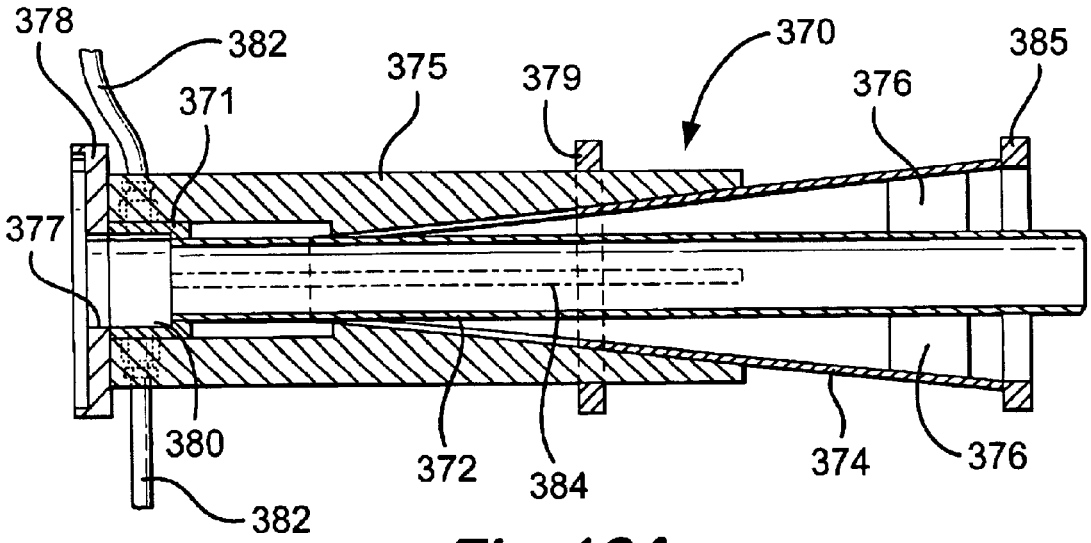
FIG. 12A is a side cross-sectional view of part of a centrifuge according to the present invention.
Figure 12B:
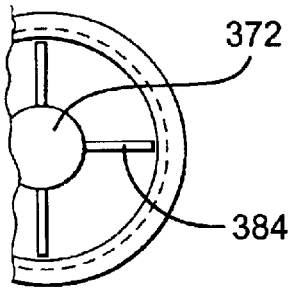
FIG. 12B is a cross-section view of the part of FIG. 12A.

FIG. 12A shows a centrifuge feed tube apparatus 370 according to the present invention which can be used with the existing feed tube of a centrifuge (e.g. with the feed tubes of the centrifuges of FIGS. 2A, 5A', 5D, 5E, 7F and 8D). An adapter 371 is sized and configured for receiving the fluid exit end of an existing feed tube (which may be shortened to accommodate the adapter 371 and/or extension 372). A feed tube extension 372 supported by supports 384 projects from the adapter 371 into a cone 374. One or more supports or gussets 376 center the feed tube extension 372 in the cone 374 and support the feed tube extension 372.

The cone 374 is mounted to a support member 375 (like the support member 244, FIG. 5A'). An end member 378 is secured to the support member 375. The end member 378 has an opening 377 for receiving a feed tube end, preferably with a tight friction fit. One or more plates may be used-as the supports 376.

With a feed tube in place within the support member 375 and the adapter 371, a chamber 380 is formed between the exterior surface of the feed tube and the interior surface of the adapter. In one particular aspect with a feed tube having an outer diameter and an adapter 371 with a corresponding inner diameter, a chamber of about nineteen cubic inches is present. Fluid is flowable between a feed tube's outer surface and an inner surface of the feed tube extension 372 into the chamber 380. Drainage tubes 382 are in fluid communication with the chamber 380. Fluid exits from the chamber 380 via the drainage tubes 382. The drainage tubes extend from the chamber 380, in one aspect to a point above a fluid pool in the centrifuge.

One or more supports 379 support the support member 375 and an end supports 385 provide a mounting structure for the end of the cone 374. Drainage tubes 382 (any desired number) may be shaped to extend between blades or flights of a conveyor. In one particular aspects, a feed tube apparatus 370 is used to extend a feed tube of an existing centrifuge to relocate the feed tube fluid exit end so that it is closer to an accelerator and/or closer to a target end of a nose member to reduce abrasive and/or erosive effects of fluid fed to a centrifuge.

Figure 13A:
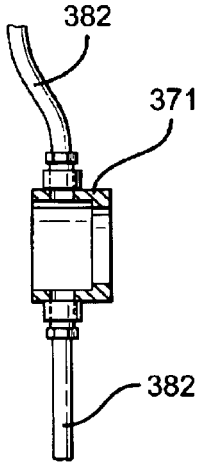
FIG. 13A is a side cross-sectional view of part of the apparatus of FIG. 12A.
Figure 13B:
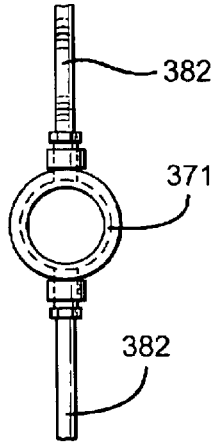
FIG. 13B is a front view of the part of FIG. 13A.

As shown in FIGS. 12A, 13A and 13B, the drainage tubes 382 are mounted to the adapter 371.

Figure 14:
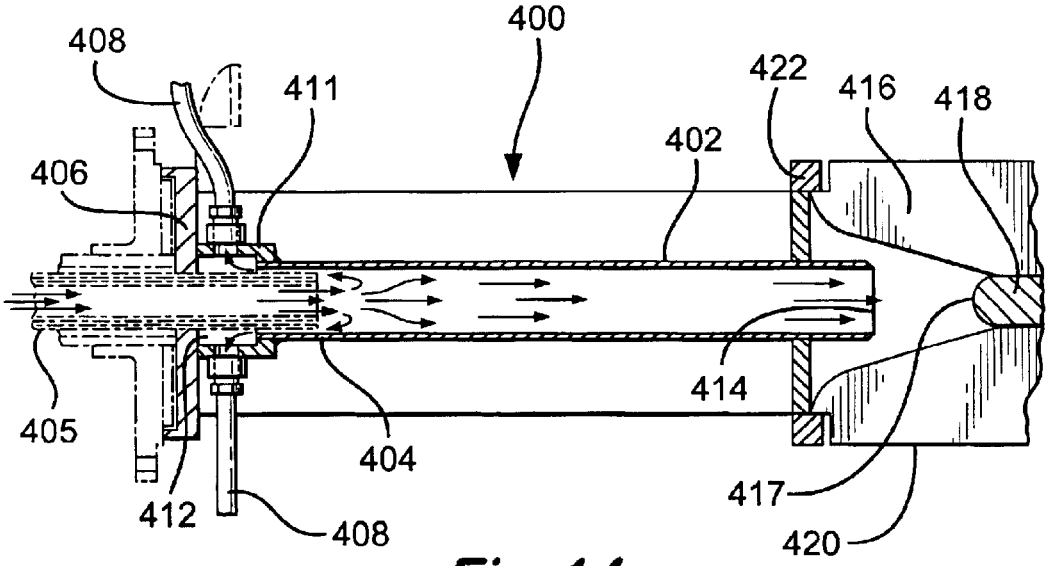
FIG. 14 is a side cross-sectional view of part of the apparatus of FIG. 12A.

FIG. 14 shows a feed tube apparatus 400 according to the present invention which employs no cone as is present in various other centrifuge embodiments disclosed herein (e.g., the cone 374, FIG. 12A; and the chamber 240, FIG. 5A'). A feed tube extension 402 has an open end 404 that receives a fluid exit end of an existing centrifuge feed tube 404 (which may be shortened). The existing feed tube 405 passes through a mounting plate 406, and an adapter 411 (like the mounting plate and adapter, FIG. 12A). Fluid is flowable between the outer surface of the feed tube 405 and the inner surface of the feed tube extension 402 into a chamber 412. Drainage tubes 408 (like the drainage tubes 382, FIG. 12A) provide for flow from the chamber 412 (like the chamber 380, FIG. 12A) into a fluid pool in the centrifuge and provide a path for backed-up fluid to drain away into the pool within the centrifuge rather than flowing out from the centrifuge's fluid introduction area or end.

The feed tube extension 402 is, in one aspect, sufficiently long that a fluid exit end 414 projects between impellers 416 of an accelerator apparatus 420 (like any impellers and any accelerator disclosed herein) and is spaced-apart from a target end 417 of a nose member 418 (shown partially) of the accelerator apparatus 420 (shown partially). The fluid exit end is supported by a support member 422 which fits into a bore of a conveyor (not shown—like any disclosed herein). Any nose member disclosed herein may be used for the nose member 418. Edges of the impellers 416 contact the support member 422.

It is within the scope of the present invention for the exit end of a feed tube to be positioned as desired in a centrifuge and, in certain aspects, to maximize the amount of fluid hitting the impellers, for the feed tube's fluid exit end to be between the outer end (e.g. tips furthest to the left in FIG. 14) of the impellers and the target end of a nose member.

The present invention, therefore, in at least certain embodiments, provides a conveyor apparatus for a centrifuge, the conveyor apparatus having a length and a plurality of spaced-apart flight members spaced apart along the length of the conveyor apparatus, a plurality of support members extending between, and connected to the spaced-apart flight members, the support members spaced-apart around the plurality of spaced-apart flight members, a nose member with a target end mounted within the plurality of support members, and a feed tube for feeding fluid to be treated into the conveyor apparatus, the feed tube having a fluid exit end within the conveyor, fluid exiting the fluid exit end flowable to the target end of the nose member. Such a conveyor apparatus may have one or some, in any possible combination, of the following: wherein the spaced-apart flight members and plurality of support members define a plurality of open areas through which fluid to be treated by the centrifuge is flowable out from the conveyor apparatus into a bowl or other receptacle of a centrifuge; accelerating apparatus within the conveyor for accelerating fluid to be treated by the centrifuge, the accelerating apparatus having a plurality of spaced-apart impellers, a nose member with a target end within the spaced-apart flight members, each impeller of the plurality of spaced-apart impellers having a first end and a second end; wherein the fluid exit end of the feed tube is between the first end of the accelerating apparatus and the target end of the nose member; wherein the fluid exit end of the feed tube is positioned so that substantially all of the fluid to be treated is acceleratable by the accelerating apparatus; wherein flow direction of fluid exiting the fluid exit end of the feed tube is changed upon the fluid impacting the target end of the nose member; at least one wear protector on at least one flight member of the spaced-apart flight members, the at least one wear protector positioned for protecting the at least one flight member from flowing fluid impacting the at least one flight member; wherein the conveyor apparatus has fluid accelerating apparatus and the at least one wear protector is positioned adjacent the accelerating apparatus; the at least one wear protector is a plurality of wear protectors each on a flight member of the plurality of spaced-apart flight members; wherein the target end of the nose member is semispherical in shape; wherein the target end of the nose member is closer to the first end of the impellers than to the second end of the impellers; wherein the target end of the nose member has a curved surface to facilitate fluid flow in a direction out from the accelerating apparatus; at least one wear shield on at least one of the support members, the at least one wear shield positioned for protecting the at least one support member from flowing fluid impacting the at least one support member; wherein the conveyor apparatus has a fluid accelerating apparatus and the at least one wear shield is positioned adjacent the accelerating apparatus; wherein the at least one wear shield is a plurality of wear shields each on a support member of the plurality of support members; wherein the feed tube has a first feed tube portion with a fluid exit end and the conveyor apparatus further includes adapter apparatus with a bore therethrough, the first feed tube portion passing through the bore, the first feed tube portion positioned so that fluid is flowable from the fluid exit end into the conveyor apparatus, the adapter apparatus having an inner chamber therein and an inner wall, the first feed tube portion having an outer surface with a space between said inner wall and said outer surface so that fluid from the fluid exit end of the first feed tube portion is flowable into the space and from the space into the inner chamber, and drain apparatus (e.g., a hole or holes and/or a tube or tubes connected to the hole or holes) for draining fluid from the inner chamber; the adapter apparatus's drain apparatus including at least one drain tube for draining fluid from the inner chamber; the at least one drain tube has an exit end disposable above a pool of fluid in a centrifuge which contains the conveyor apparatus; wherein the feed tube also has a second feed tube portion secured to the adapter apparatus with an inner surface of the second feed tube portion spaced-apart from an outer surface of the first feed tube portion so that fluid is passable between said inner surface and said outer surface into the inner chamber; chamber apparatus encircling a portion of the feed tube for containing fluid exiting from the feed tube within the conveyor apparatus; wherein the chamber apparatus is cylindrical or conical; and/or wherein the feed tube has a plurality of hollow tube sections in fluid communication with each other.

The present invention, therefore, in at least certain embodiments, provides a centrifuge with any conveyor apparatus disclosed herein according to the present invention and a bowl with a hollow interior and a first bowl end spaced-apart from a second bowl end, apparatus for selectively rotating the bowl, the conveyor apparatus rotatably mounted in the bowl.

The present invention, therefore, in at least certain embodiments, provides a feed apparatus for feeding and accelerating fluid in a centrifuge, the feed apparatus having feed tube apparatus for feeding fluid to be treated into a centrifuge, the feed tube having a fluid exit end, a plurality of accelerating impellers for accelerating the fluid to be treated, the feed tube exit end adjacent the accelerating impellers, a nose member with a target end positioned within the accelerating impellers, and the feed tube exit end positioned so that fluid is flowable therefrom to impact the target end of the nose member; and a centrifuge with such feed apparatus.

A method for separating components of a feed material, the method including introducing feed material into a centrifuge, the centrifuge like any disclosed herein, and separating components of the material with the centrifuge.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. Conveyor apparatus for a centrifuge, the conveyor apparatus having a length and comprising a plurality of spaced-apart flight members spaced apart along the length of the conveyor apparatus, a plurality of support members extending between, and connected to the spaced-apart flight members, the support members spaced-apart around the plurality of spaced-apart flight members, a nose member with a target end mounted within the plurality of support members, a feed tube for feeding fluid within the conveyor apparatus, the feed tube having a fluid exit end within the conveyor apparatus, fluid exiting the fluid exit end flowable to the target end of the nose member, wherein the feed tube has a first feed tube portion with a fluid exit end and the conveyor apparatus further comprising adapter apparatus with a bore therethrough, the first feed tube portion passing through the bore, the first feed tube portion positioned so that fluid is flowable from the fluid exit end into the conveyor apparatus, the adapter apparatus having an inner chamber therein and an inner wall, the first feed tube portion having an outer surface with a space between said inner wall and said outer surface so that fluid from the fluid exit end of the first feed tube portion is flowable into the space and from the space into the inner chamber, and drain apparatus for draining fluid from said inner chamber.

2. The conveyor apparatus of claim 1 wherein the spaced-apart flight members and plurality of support members define a plurality of open areas through which fluid to be treated by the centrifuge is flowable out from the conveyor apparatus.

3. The conveyor apparatus of claim 2 further comprising at least one wear protector on at least one flight member of the plurality of spaced-apart flight members, the at least one wear protector positioned for protecting the at least one flight member from flowing fluid impacting the at least one flight member.

4. The conveyor apparatus of claim 3 wherein the conveyor apparatus has fluid accelerating apparatus and the at least one wear protector is positioned adjacent the accelerating apparatus.

5. The conveyor apparatus of claim 3 wherein the at least one wear protector is a plurality of wear protectors each on a flight member of the plurality of spaced-apart flight members.

6. The conveyor apparatus of claim 1 further comprising accelerating apparatus within the conveyor apparatus for accelerating fluid to be treated by the centrifuge, the accelerating apparatus having a plurality of spaced-apart impellers and including said nose member, each impeller of the plurality of spaced-apart impellers having a first end and a second end.

7. The conveyor apparatus of claim 6 wherein the fluid exit end of the feed tube is between the first end of the impellers and the target end of the nose member.

8. The conveyor apparatus of claim 6 wherein the target end of the nose member is closer to the first end of the impellers than to the second end of the impellers.

9. The conveyor apparatus of claim 6 wherein the fluid exit end of the feed tube is positioned so that substantially all of the fluid to be treated is acceleratable by the accelerating apparatus.

10. The conveyor apparatus of claim 6 wherein the target end of the nose member has a curved surface to facilitate fluid flow in a direction out from the accelerating apparatus.

11. The conveyor of claim 6 wherein flow direction of fluid exiting the fluid exit end of the feed tube is changed upon the fluid impacting the target end of the nose member.

12. The conveyor apparatus of claim 1 wherein the target end of the nose member is semi-spherical in shape.

13. The conveyor apparatus of claim 1 further comprising at least one wear shield on at least one of the support members, the at least one wear shield positioned for protecting the at least one support member from flowing fluid impacting the at least one support member.

14. The conveyor apparatus of claim 13 wherein the conveyor apparatus has a fluid accelerating apparatus and the at least one wear shield is positioned adjacent the accelerating apparatus.

15. The conveyor apparatus of claim 13 wherein the at least one wear shield is a plurality of wear shields each on a support member of the plurality of support members.

16. The conveyor apparatus of claim 1 further comprising the adapter apparatus's drain apparatus including at least one drain tube for draining fluid from the space.

17. The conveyor apparatus of claim 16 wherein the at least one drain tube has an exit end disposable above a pool of fluid in a centrifuge which contains the conveyor apparatus.

18. The conveyor apparatus of claim 1 wherein the feed tube also comprises a second feed tube portion secured to the adapter apparatus with an inner surface of the second feed tube portion spaced-apart from an outer surface of the first feed tube portion so that fluid is passable between said inner surface and said outer surface into the inner chamber.

19. The conveyor apparatus of claim 1 further comprising chamber apparatus encircling a portion of the feed tube.

20. The conveyor apparatus of claim 19 wherein the chamber apparatus is conical.

21. The conveyor apparatus of claim 1 wherein the feed tube is comprised of a plurality of hollow tubes in fluid communication with each other.

22. A centrifuge comprising a bowl with a hollow interior and a first bowl end spaced-apart from a second bowl end, apparatus for selectively rotating the bowl, conveyor apparatus rotatably mounted in the bowl, the conveyor apparatus comprising a plurality of spaced-apart flight members spaced apart along the length of the conveyor apparatus, a plurality of support members extending between, and connected to the spaced-apart flight members, the support members spaced-apart around the plurality of spaced-apart flight members, a nose member with a target end within the plurality of support members, and a feed tube for feeding fluid having a fluid exit end within the conveyor apparatus, fluid exiting the fluid exit end flowable to the target end of the nose member, wherein the feed tube has a first feed tube portion with a fluid exit end and the conveyor apparatus further comprising adapter apparatus with a bore therethrough, the first feed tube portion passing through the bore, the first feed tube portion positioned so that fluid is flowable from the fluid exit end into the conveyor apparatus, the adapter apparatus having an inner chamber therein and an inner wall, the first feed tube portion having an outer surface with a space between said inner wall and said outer surface so that fluid from the fluid exit end of the first feed tube portion is flowable into the space and from the space into the inner chamber, and drain apparatus for draining fluid from said inner chamber.

23. The centrifuge of claim 22 wherein the centrifuge has fluid accelerating apparatus and the fluid exit end of the feed tube is positioned so that substantially all of the fluid to be treated is acceleratable by the accelerating apparatus.

24. The centrifuge of claim 22 comprising at least one wear protector on at least one flight member of the plurality of spaced-apart flight members.

25. The centrifuge of claim 22 further comprising at least one wear shield on at least one of the support members.

26. A feed apparatus for feeding and accelerating fluid in a centrifuge, the feed apparatus comprising feed tube apparatus for feeding fluid to be treated into a centrifuge, the feed tube having a fluid exit end, a plurality of accelerating impellers for accelerating the fluid to be treated, the feed tube exit end adjacent the accelerating impellers, a nose member with a target end positioned within the accelerating impellers, the feed tube exit end positioned so that fluid is flowable therefrom to impact the target end of the nose member, the feed tube having a first feed tube portion with a fluid exit end, adapter apparatus with a bore therethrough, the first feed tube portion passing through the bore, the first feed tube portion positioned so that fluid is flowable from the fluid exit end, the adapter apparatus having an inner chamber therein and an inner wall, the first feed tube portion having an outer surface with a space between said inner wall and said outer surface so that fluid from the fluid exit end of the first feed tube portion is flowable into the space and from the space into the inner chamber, and drain apparatus for draining fluid from said inner chamber.

27. A centrifuge comprising a bowl with a hollow interior and a first bowl end spaced-apart from a second bowl end, apparatus for selectively rotating the bowl, and feed apparatus with feed tube apparatus for feeding fluid to be treated into a centrifuge, the feed tube having a fluid exit end, a plurality of accelerating impellers for accelerating the fluid to be treated, the feed tube exit end adjacent the accelerating impellers, a nose member with a target end positioned within the accelerating impellers, and the feed tube exit end positioned so that fluid is flowable therefrom to impact the target end of the nose member, the feed tube having a first feed tube portion with a fluid exit end, adapter apparatus with a bore therethrough, the first feed tube portion passing through the bore, the first feed tube portion positioned so that fluid is flowable from the fluid exit end, the adapter apparatus having an inner chamber therein and an inner wall, the first feed tube portion having an outer surface with a space between said inner wall and said outer surface so that fluid from the fluid exit end of the first feed tube portion is flowable into the space and from the space into the inner chamber, and drain apparatus for draining fluid from said inner chamber.

28. A method for separating components of a feed material, the method comprising introducing feed material into a centrifuge, the centrifuge comprising a bowl with a hollow interior and a first bowl end spaced-apart from a second bowl end, apparatus for selectively rotating the bowl, conveyor apparatus rotatably mounted in the bowl, the conveyor apparatus comprising a plurality of spaced-apart flight members spaced apart along the length of the conveyor apparatus, a plurality of support members extending between, and connected to the spaced-apart flight members, the support members spaced-apart around the plurality of spaced-apart flight members, a nose member with a target end within the plurality of support members, and a feed tube for feeding fluid having a fluid exit end within the conveyor apparatus, fluid exiting the fluid exit end flowable to the target end of the nose member, wherein the feed tube has a first feed tube portion with a fluid exit end and the conveyor apparatus further comprising adapter apparatus with a bore therethrough, the first feed tube portion passing through the bore, the first feed tube portion positioned so that fluid is flowable from the fluid exit end into the conveyor apparatus, the adapter apparatus having an inner chamber therein and an inner wall, the first feed tube portion having an outer surface with space between said inner wall and said outer surface so that fluid from the fluid exit end of the first feed tube portion is flowable into the space and from the space into the inner chamber, and drain apparatus for draining fluid from said inner chamber, and separating components of the material with the centrifuge.

* * * * *